US009565924B2

(12) United States Patent
Macaskill

(10) Patent No.: US 9,565,924 B2
(45) Date of Patent: Feb. 14, 2017

(54) CAMPING HAMMOCK

(71) Applicant: Andrew Macaskill, Port Moody (CA)

(72) Inventor: Andrew Macaskill, Port Moody (CA)

( * ) Notice: Subject to any disclaimer, the term of this patent is extended or adjusted under 35 U.S.C. 154(b) by 48 days.

(21) Appl. No.: 14/156,914

(22) Filed: Jan. 16, 2014

(65) Prior Publication Data

US 2014/0196209 A1 Jul. 17, 2014

Related U.S. Application Data

(60) Provisional application No. 61/753,642, filed on Jan. 17, 2013.

(51) Int. Cl.
*A45F 3/22* (2006.01)

(52) U.S. Cl.
CPC ..... *A45F 3/22* (2013.01)

(58) Field of Classification Search
CPC ..... A45F 3/22
USPC ..... 5/120–123, 127–128, 130
See application file for complete search history.

(56) References Cited

U.S. PATENT DOCUMENTS 4,320,542 A 3/1982 Cohen
4,686,720 A * 8/1987 Newell ..... 5/121
5,857,231 A * 1/1999 Wade ..... 5/120
6,185,763 B1 2/2001 Hennessy
6,701,549 B1 3/2004 Erikson
6,851,137 B2 * 2/2005 Hennessy ..... 5/120
6,865,757 B2 3/2005 Hennessy
8,356,370 B1 * 1/2013 Clark et al. ..... 5/123

* cited by examiner

*Primary Examiner* — Fredrick Conley
(74) *Attorney, Agent, or Firm* — Katten Muchin Rosenman LLP

(57) ABSTRACT

A hammock formed by suspending a substantially rectilinear section of material by two diagonally-opposed corners to two respective anchor points. Preferably, the other two diagonally-opposed corners of the substantially rectilinear section of material are anchored to respective anchor points below the two suspension anchor points. The hammock preferably has a suspension line and a body, wherein the suspension line and body are separate. Preferably, the body includes the substantially rectilinear section of material, and an overlying rain-fly. A method of suspending such a hammock includes suspending the suspension line to the two suspension anchor points, and suspending the hammock body from the suspension line. Preferably, the other two diagonally-opposed corners of the substantially rectilinear section of material are then anchored to respective anchor points below the two suspension anchor points.

20 Claims, 19 Drawing Sheets

CAMPING HAMMOCK

This application claims priority to U.S. Patent Appln. No. 61/753,642, filed Jan. 17, 2013, the entire contents of which are incorporated herein by reference.

FIELD OF THE INVENTION

The present invention relates generally to hammocks and in particular to hammocks having a substantially flat sleeping surface, and to a lightweight, enclosed camping hammock incorporating the same.

BACKGROUND

Enclosed hammocks used for camping are well known. These hammocks are almost exclusively made by suspending a substantially rectangular section of fabric from opposing edges. The most basic camping hammocks simply gather the fabrics short edges that are then used to suspend the hammock, and may include a rain fly made from a sheet of waterproof fabric that is suspended over the hammock to keep the user protected from precipitation. Other common attributes include a mesh covering to protect the user from insects, and the use of rigid poles to increase the internal volume of the hammock or create a more comfortable sleep surface.

Such hammocks typically suffer from several drawbacks, namely, a non-flat sleep surface, very high tension in the suspension lines, difficulty in entering and exiting, and a minimal internal volume—creating a confined space for the user and limiting the stowage of equipment. It is also difficult to find a suitable location to set up such known hammocks.

Having a non-flat sleep surface is a well-known issue with traditional hammocks, because it can cause users to experience back pain when used for extended periods, such as sleeping overnight. Many users also prefer to sleep on their side or stomach, which can be difficult or impossible to do in a traditional hammock. Previous attempts to overcome this problem include various embodiments using rigid members to create a framed sleep surface. This significantly increases both the weight and bulk of the hammock which is highly unwanted by adventurers seeking lightweight and compact products. U.S. Pat. No. 6,701,549 to Eriksen discloses a hammock that creates a generally level sleep surface without using any rigid poles by using a novel arrangement of ropes. U.S. Pat. No. 6,865,757 to Hennessy discloses a hammock using an asymmetrical fabric section to improve user posture without the use of rigid poles. While both of these patents improve user comfort, neither provides a sleep surface capable of being used in any desired sleep position.

Traditional hammocks not using rigid members must attempt to minimize the bent posture that causes user discomfort while sleeping, and reduce the amount of slack within the hammock, by tensioning the suspension lines such that when the user enters the hammock, sag will be minimized. These highly tensioned suspension lines can easily overload the posts and trees that the hammock is anchored to, damages trees by cutting into the bark, and requires strong, low stretch rope that can be expensive and heavy. Special webbing straps known as "treehuggers" help reduce the damage inflicted on the tree, but the other problems have not been overcome.

Entering and exiting traditional hammocks has always been cumbersome and requires experience in order to do so comfortably. U.S. Pat. No. 6,185,763 to Hennessy discloses a hammock with a slit formed longitudinally on the underside of the hammock sleep surface to facilitate user access. This slit self closes when the user places weight within the hammock causing the door to close upon the user's leg while entering and can easily open inadvertently.

Lack of internal space is another major drawback of traditional hammocks and limits users to bringing inside only items required for sleeping, such as a sleeping pad, sleeping bag and clothes; and a few small items such as a headlamp, knife and glasses. The users other equipment, such as backpacks, stoves, water bottles, cameras, clothing, food, and so forth must be stored outside the hammock which offers less protection. This lack of internal space also limits user comfort within the hammock as they cannot easily move about to change clothes, get in and out of their sleeping bag, or wait out periods of inclement weather. U.S. Pat. No. 4,320,542 to Cohen discloses a suspended shelter using a series of pole assemblies to provide the user with an enlarged internal volume.

Another drawback of the geometry of traditional hammocks is that preferred anchor point locations are between waist and head height and spaced between 10 to 20 feet apart. Needless to say, finding sturdy anchor points that meet these requirements is not always possible.

Although camping hammocks have been considered, improvements are sought. It is therefore an object of the present invention to provide a novel hammock system and method of creating a substantially flat suspended sleep surface.

SUMMARY OF THE INVENTION

Accordingly, in one aspect of the present invention there is provided a hammock formed by suspending a substantially square section of material by two diagonally opposed corners.

According to another aspect of the present invention, a hammock comprises a suspension line and a body, wherein the suspension line and body are separate.

According to yet another aspect of the present invention, a method of suspending a hammock comprises: suspending a suspension line about two support structures; and suspending a hammock body from said suspension line.

BRIEF DESCRIPTION OF THE DRAWINGS

Embodiments will now be described more fully with reference to the accompanying drawings in which.

DETAILED DESCRIPTION OF THE PRESENTLY PREFERRED EMBODIMENTS

Figure 1:
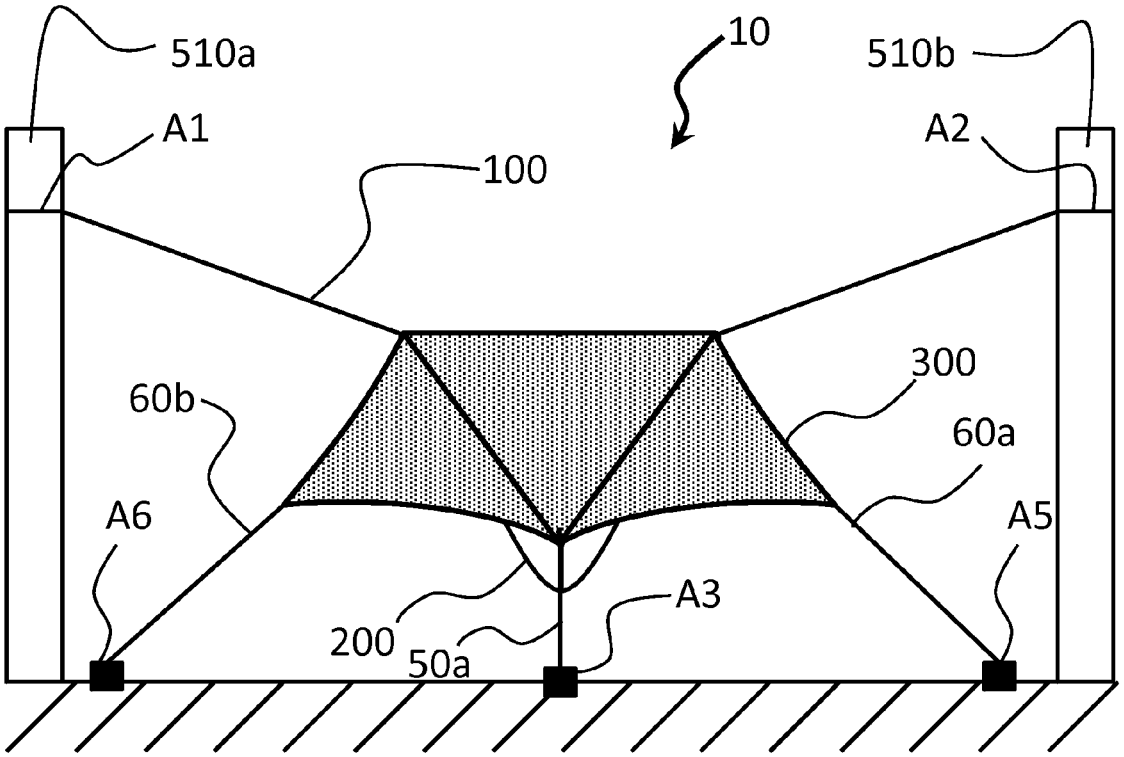
FIG. 1 is a schematic front elevation view of a suspended hammock comprising a suspension line, a body with a substantially flat sleep surface, and a fly in accordance with the subject application.

Turning now to FIG. 1, a hammock according to a preferred embodiment is shown and is generally identified by reference numeral 10. In this embodiment, the hammock 10 creates a substantially flat interior surface for a user to sleep on. As can be seen hammock 10 comprises suspension line 100, body 200 and fly 300. Suspension line 100 is attached about anchor points A1 and A2, fly 300 is attached to suspension line 100, and body 200 is attached to suspension line 100 thus suspending body 200 above the ground. The sides of fly 300 are tensioned using guy ropes 60*a* and 60*b* and attached about anchor points A5 and A6, respectively, in a direction generally in the same vertical plane of anchor points A1 and A2. The anchor points A5 and A6 may be on the ground, or on an anchor location vertically below anchor points A1 and A2. The ends of fly 300 and body 200 are pulled outward using guy-ropes 50*a* and 50*b* and attached about anchor points A3 and A4, respectively, in a direction generally perpendicular to the vertical plane of anchor points A1, A2, A5 and A6, thus creating an suspended enclosure with a substantially flat interior surface perfectly suited for sleeping within. While guy ropes 50*a* and 50*b* are not required to use body 200, it provides a more comfortable experience. Even the use of only one guy rope will improve the comfort of the user.

Figure 2:
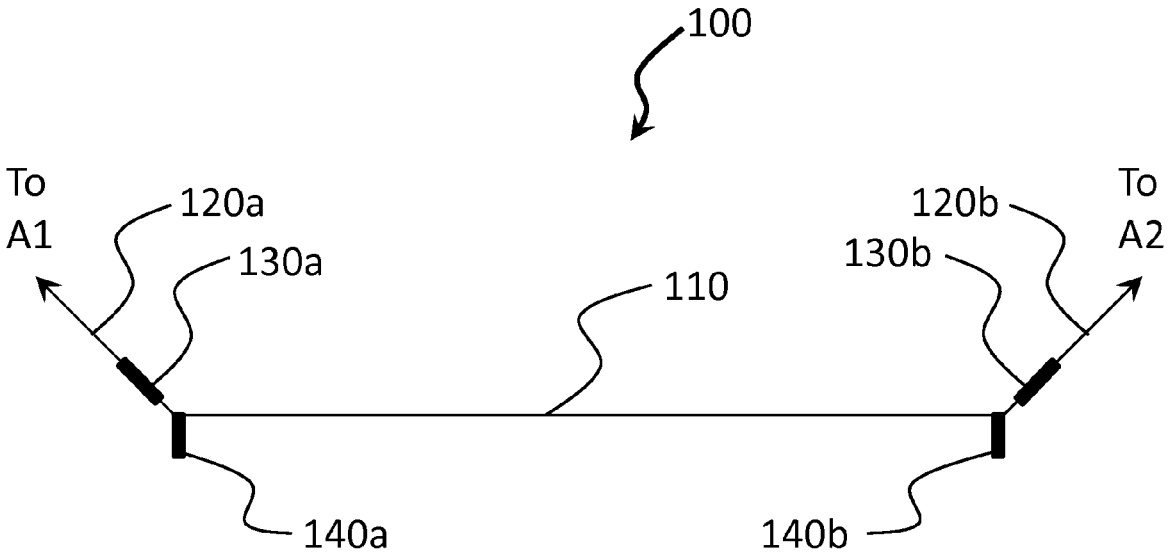
FIG. 2 is a front elevation view of the suspension line of FIG. 1.
Figure 3:
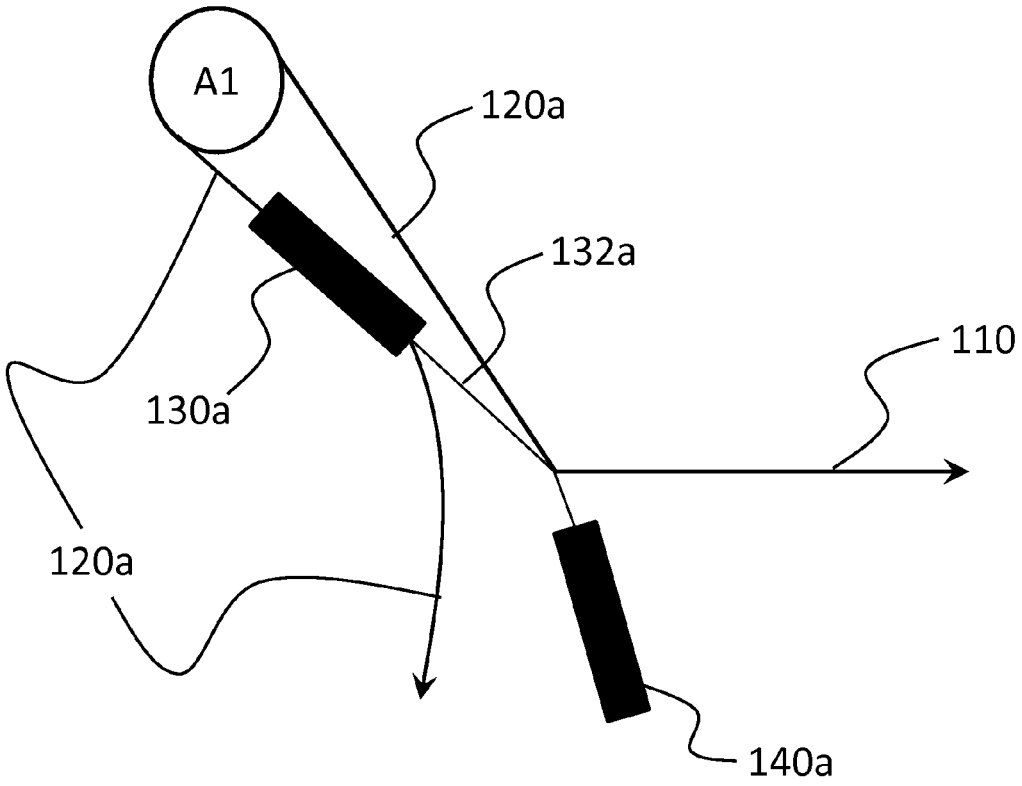
FIG. 3 is a front elevation view of a portion of the suspension line of FIG. 2.
Figure 4A:
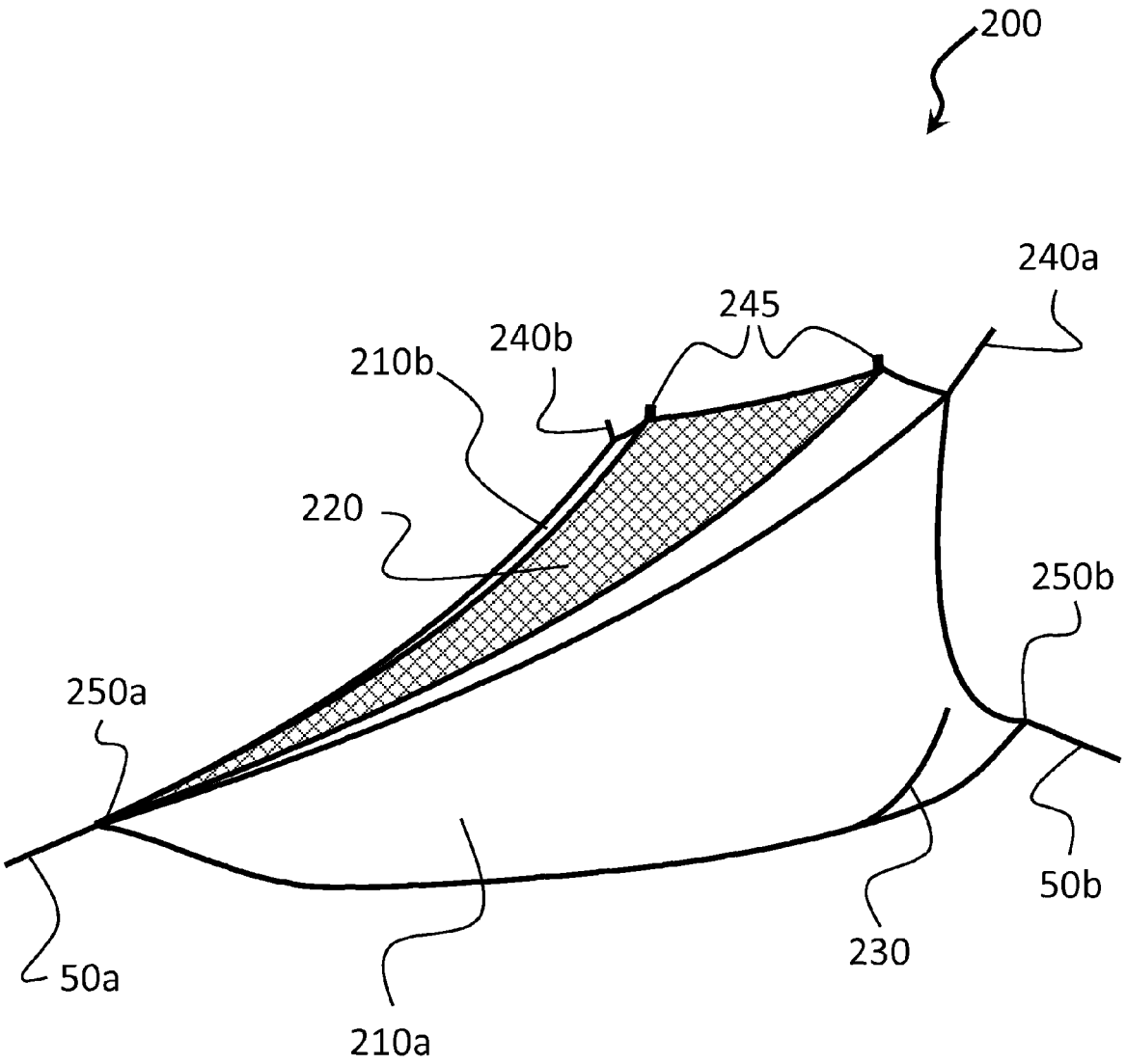
FIG. 4A is a perspective view of the hammock body of FIG. 1.
Figure 4B:
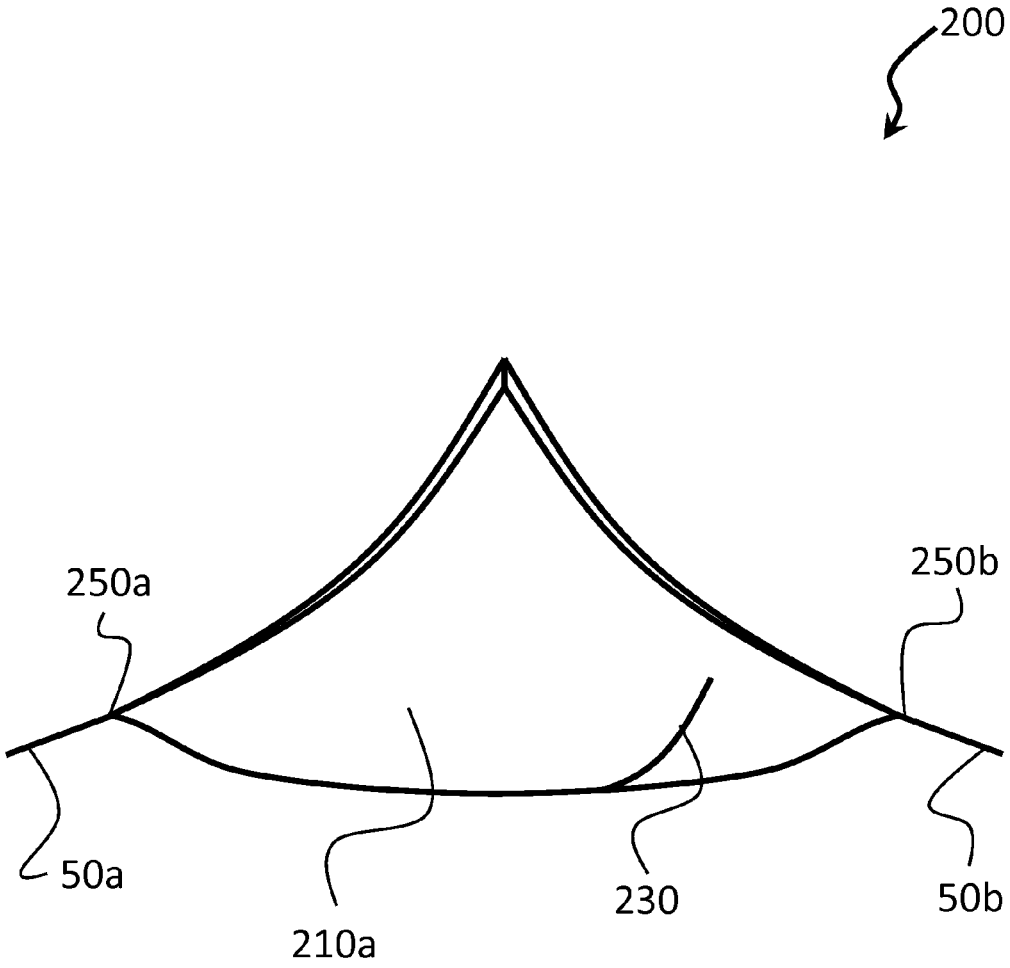
FIG. 4B is a side elevation view of the hammock body of FIG. 4A.
Figure 4C:
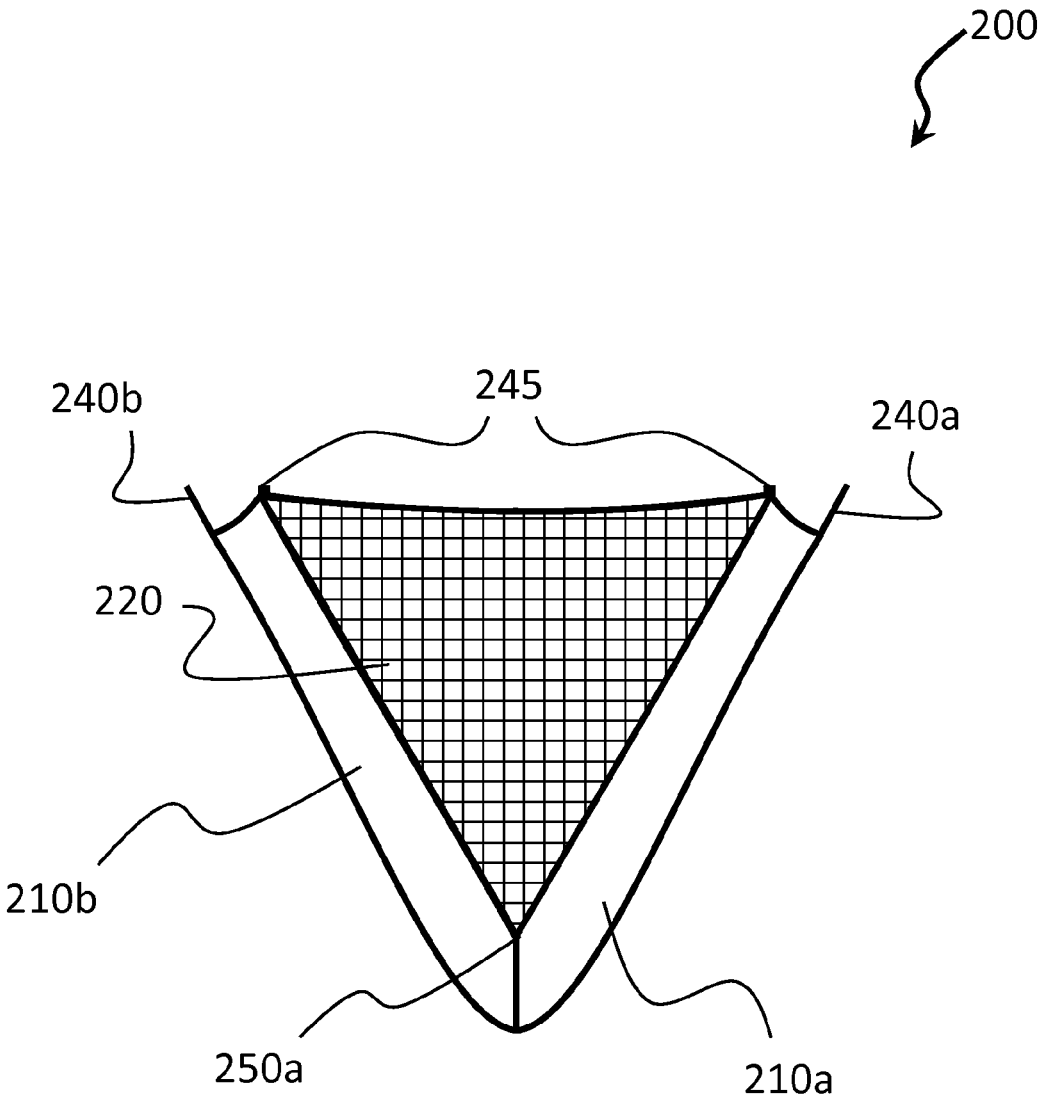
FIG. 4C is a front elevation view of the hammock body of FIG. 4A.
Figure 4D:
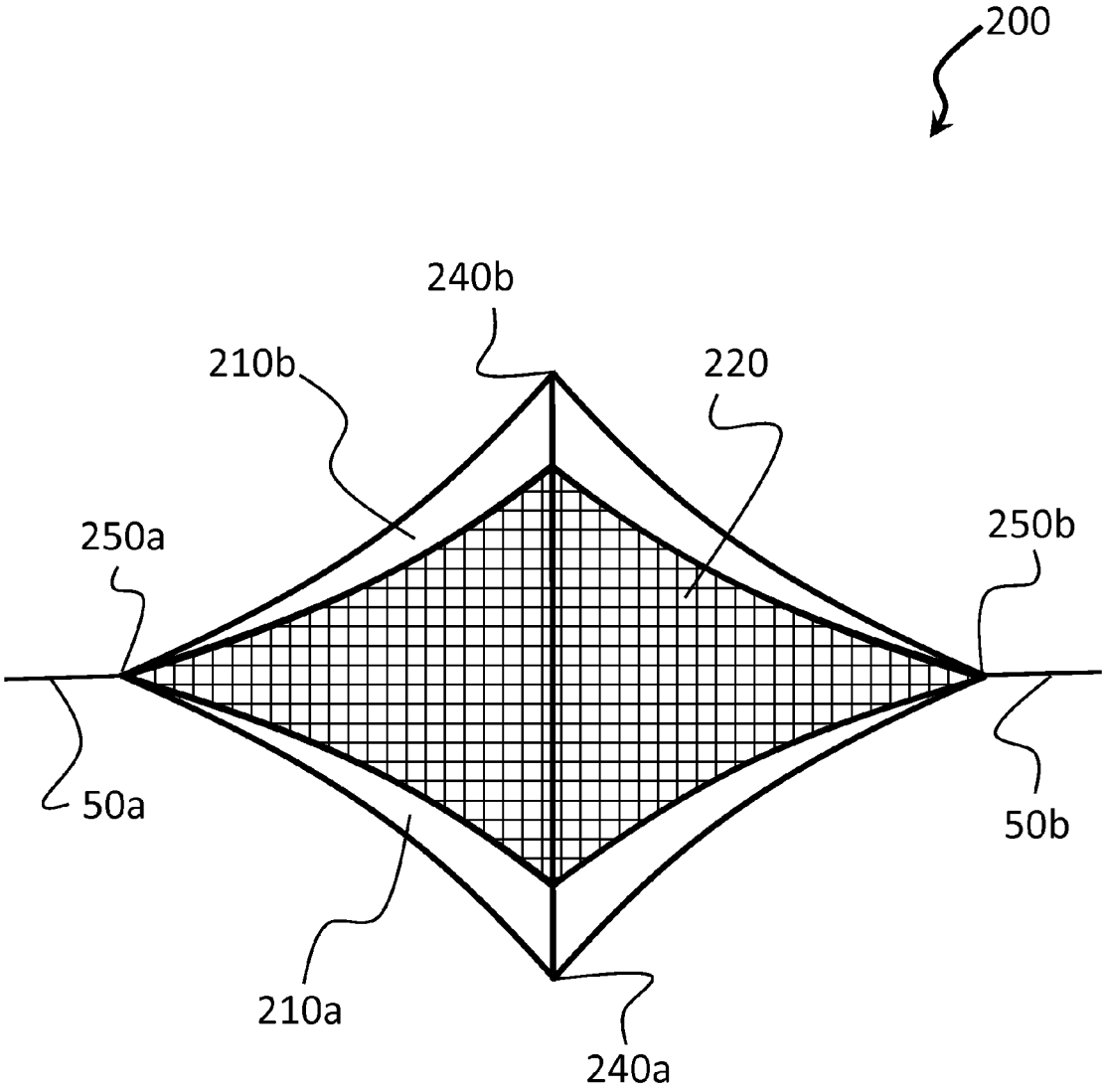
FIG. 4D is a top view of the hammock body of FIG. 4A.

Suspension line 100, shown in better detail in FIGS. 2 and 3, is used to suspend fly 300 and body 200 while doing so in a simplified manner, and comprises, primarily, (i) ropes 110, 120*a*, and 120*b*, (ii) tensioners 130*a* and 130*b*, and (iii) connectors 140*a* and 140*b*. One end of each of ropes 120*a* and 120*b* is affixed to one of the opposing ends of rope 110. Ropes 120*a* and 120*b* are then used to attach suspension line 100 about overhead anchor points A1 and A2. In this embodiment, ropes 110, 120*a*, and 120*b* are preferably comprised of a single length of 3 mm Dyneema® rope, although ropes 110, 120*a*, and 120*b* may comprise multiple sections of rope preferably permanently attached to each other to create a single length of rope. In this embodiment, a single 36 m length of 3 mm Dyneema® rope is preferably used because of its outstanding strength to weight ratio, low stretch, abrasion and cut resistance, and UV resistance characteristics. 3 mm Dyneema® rope has an 1100 KG breaking strength while weighing only 7 grams per meter. While 35 m of 3 mm Dyneema® rope is preferred in this embodiment, other lengths, thicknesses and brands of line, such as Ultra-high-molecular-weight polyethylene (UHMWPE, UHMW), for example, Spectra® may be used; as well as other materials offering low stretch and sufficient strength, such as braided polyester, high density polyethylene (HDPE) or polypropylene, in a rope or webbing format, or aluminum, steel or stainless steel wire. The lengths of such "rope" 120*a* and 120*b* in this embodiment are each, preferably, approximately 12 meters to allow sufficient length to accommodate setting up in a variety of situations, and preferably, approximately 3 mm in diameter to provide sufficient strength and low stretch, although lengths between 2 and 60 meters and diameters between 2 mm and 10 mm could be used. While suspension line 100 is described as being used with hammock 10, this type of suspension line (or "rope") can also provide benefits to prior art hammocks as well.

Suspension line 100 is used to suspend fly 300 and body 200 above the ground preferably by affixing ropes 120*a* and 120*b* to overhead anchor points A1 and A2, respectively. In this embodiment, anchor points A1 and A2 are each part of a trunk of different trees that are sufficiently high and strong enough to withstand the applied forces and proximate enough one another to be used practically, e.g., approximately 6-20 feet apart. While anchor points A1 and A2 in this embodiment are described as being trees, other suitable strong and tall anchor points may be used such as parts of a flag post, railing, rock, rock face, branch, rafter, beam, or similar mounting point. Affixing ropes 120*a* and 120*b* to overhead anchor points A1 and A2, respectively, typically is done by looping the rope around the anchor point once or twice then tensioning the ropes 120*a* and 120*b* using tensioners 130*a* and 130*b*, respectively.

To help minimize damage to the surface of trees supporting ropes 120*a* and 120*b*, the use of webbing straps known as "treehuggers" or "tree straps" is well known, and may be used with the present invention. These webbing straps are discrete components typically made from 1.5 inch wide nylon, polyester or polypropylene webbing with sewn loops or metal d-rings appointed to either end. These straps may be used with ropes 120*a* and 120*b*, where they are first wrapped about the tree at the desired anchor point location, and the free end of ropes 120*a* and 120*b* are passed through the ends loops or d-rings before returning to tensioners 130*a* and 130*b*. Alternatively, a section of each of ropes 120*a* and 120*b* are encompassed by a 2 foot length of ¼ inch nylon reinforced tubing 80 (not shown) with a high friction exterior surface. Tubing 80 is placed in contact with the surface of the trees in which ropes 120*a* and 120*b* are affixed thereabout to provide an increased surface area, thereby decreasing pressure and preventing damage to the surface of the trees. Ropes 120*a* and 120*b* are able to be adjusted while tubing 80 remains in place due to its high friction exterior surface. While tubing 80 is described as be ¼ inch nylon tubing, various lengths, internal and external diameters, materials, and cross sections may be used, such as reinforced, solid or woven PVC, vinyl, rubber, metal or nylon tubing in a round, triangular or square cross section, with various interior and exterior surface finishes to increase and decrease the friction as necessary. Tubing 80 is beneficial over webbing straps because tubing 80 are integrated with ropes 120*a* and 120*b*, thereby reducing the number of discrete components, reducing weight, and facilitating the setting up and adjustment of anchor points A1 and.

Tensioners 130*a* and 130*b* are preferably used to maintain tension in and to prevent slippage of ropes 120*a* and 120*b*, respectively, especially when a load is applied to connecters 140*a* and 140*b*, such as when a user enters body 200. Tensioner 130*a* is preferably connected by a short length of rope 132*a* to the point where rope 110, rope 120*a*, and connector 140*a* are all connected. Similarly, tensioner 130*b* is preferably connected by a short length of rope 132*b* to the point where rope 110, rope 120*b*, and connector 140*b* are all connected. In this embodiment, tensioners 130*a* and 130*b* are preferably cam-cleat type rope retainers which hold ropes 120*a* and 120*b*, respectively, securely in place when under tension, while and allowing for easy adjustment of rope length. While a cam-cleat is described as being used in this embodiment, other rope retainers may be used as tensioners 130*a* and 130*b*, such as a jam-cleat, a clam-cleat, zigzag cleat, FIG. 9, or other tensioning device that allows for a simple and secure fastening and adjustment of ropes 120*a* and 120*b*. Alternatively, knots could be used in place of tensioners 130*a* and 130*b* (e.g., taut-line hitch), but require knowledge of knot tying, and are sometimes time consuming to fasten, adjust, and remove. The sections of ropes 120*a* and 120*b* that hang loose after passing through tensioners 130*a* and 130*b*, respectively, may be coiled, placed in a bag, or left hanging. While tensioners 130*a* and 130*b* are described as be connected to the point where rope 110 is affixed to ropes 120*a* or 120*b* by means of rope 132*a* and 132*b*, respectively, the tensioners 130*a* and 130*b* can alternatively be affixed to ropes 120*a* and 120*b*, respectively, directly or in conjunction with an short length of rope and Prusik knot. As used herein, "connected" or "coupled" may include direct or indirect connections or couplings using direct or intermediate structures.

Connectors 140*a* and 140*b* of suspension line 100 are preferably used to connect suspension line 100 to mounting points 240*a* and 240*b*, respectively. Connector 140*a* is securely connected to the point where rope 110, rope 120*a*, and tensioner 130*a* are all connected. Similarly, connector 140*b* is securely connected to the point where rope 110, rope 120*b*, and tensioner 130*b* are all connected. A secure connection may be created through mechanical means using a mechanical fastener, or stitched together, or through a friction means, such as a knot. Connectors 140*a* and 140*b* are sufficiently strong to support the weight of a 5001*b* user suspended within body 200. In this embodiment, connectors 140*a* and 140*b* are preferably metal wire gate rock climbing carabineers due to their simplicity, strength and ease of connection. Alternatively, connectors 140*a* and 140*b* could be synthetic or metal quick release buckles, hooks, d-rings, carabineers, loop of webbing, or any other suitable means for quickly and securely creating temporary connections, so long as mounting points 240*a* and 240*a*, and line openings 330*a* and 330*b* are matched to receive the connection.

The geometry of suspension line 100 is such that the distance between connectors 140*a* and 140*b* preferably remains the same regardless of the position of anchor points A1 and A2, creating connection points at a predetermined spacing for connecting fly 300 and body 200. In this embodiment, the length of rope 110 is such that the distance between connector 140*a* and 140*b* is preferably six feet (72 inches), although distances between 12 and 180 inches may be used.

Separating suspension line 100 from body 200 and fly 300 offers several advantages to setting up hammock 10. By having the suspension line separate from body 200 and fly 300, the user does not have to worry about dirtying body 200 and fly 300 during set up from these components touching the ground, there are fewer components to become entangled or ensnared, the risk of having body 200 or fly 300 blown away by wind is significantly decreased, and attaching ropes 120*a* and 120*b* about anchor points A1 and A2, respectively, is far easier since there are less components to work with.

When set up, body 200 forms an enclosure with an interior volume having a substantially flat surface for sleeping that is not in direct contact with the ground, as shown in FIGS. 4A to 4D. Body 200 is preferably rectilinear in shape (e.g., rectangular, but most preferably square), and is preferably created substantially from body panel 210*a* and 210*b*, mesh panel 220, door 230, connectors 240*a* and 240*b*, clips 245, and mounting points 250*a* and 250*b*, along with necessary reinforcements, and interior accessories that will be described further below. Body panel 210*a* is preferably generally triangular in shape (FIG. 5) and connects to body panel 210*b* along their entire bottom edge thereby creating a substantially square section of material. Body panel 210*b* is preferably a mirror image of body panel 210*a*. Mesh panel 220 is preferably substantially rhombus in shape and slightly folded along the line formed by the most proximal opposing corners, then connected to body panels 210*a* and 210*b* to create a structure that is generally tetrahedral in shape. Mounting points 250*a* and 250*b* are located at opposing ends of the edge formed where body panels 210*a* and 210*b* are connected.

Figure 5:
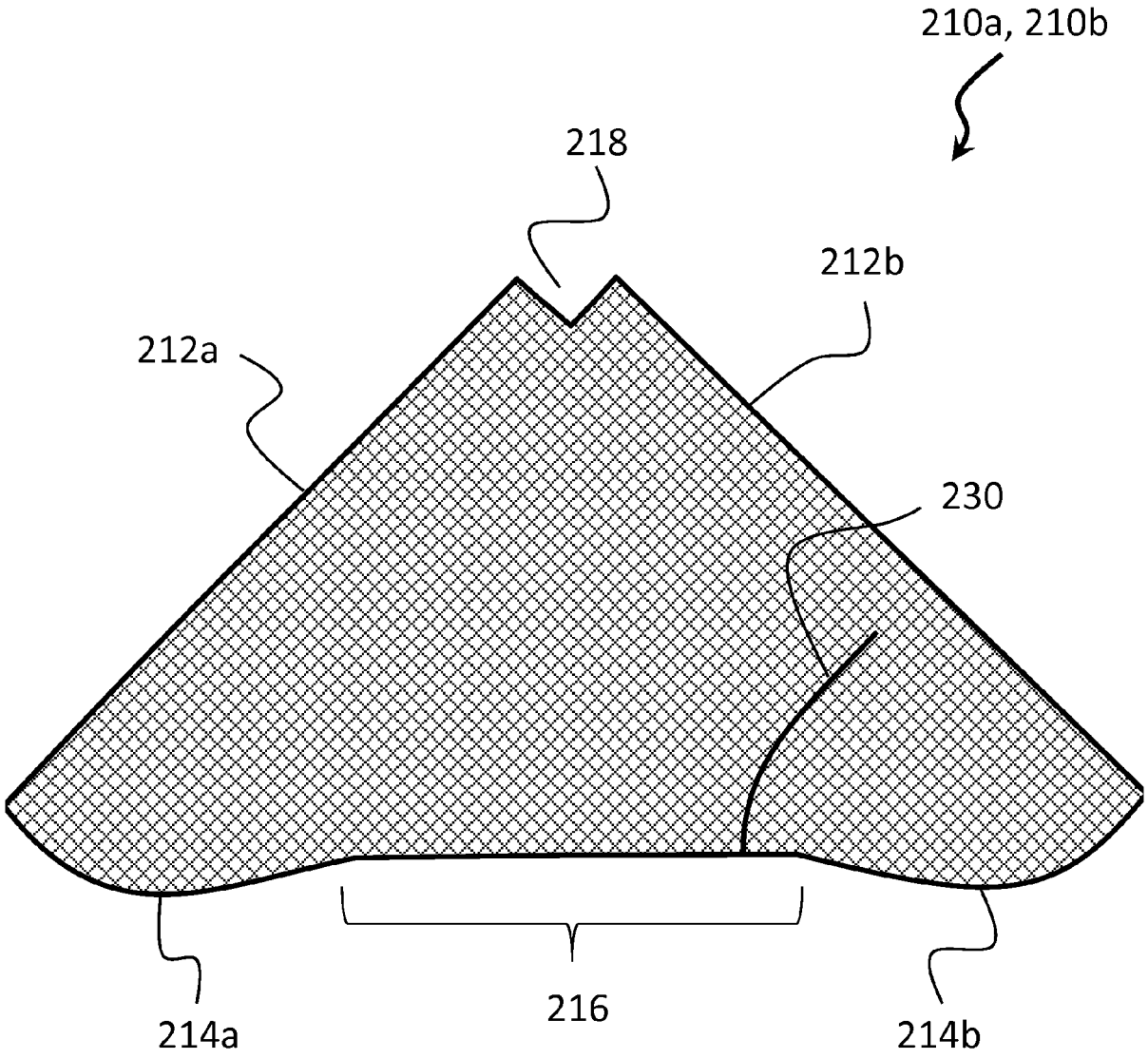
FIG. 5 is a top view of a body panel forming part of the hammock body of FIG. 4A.
Figure 6A:
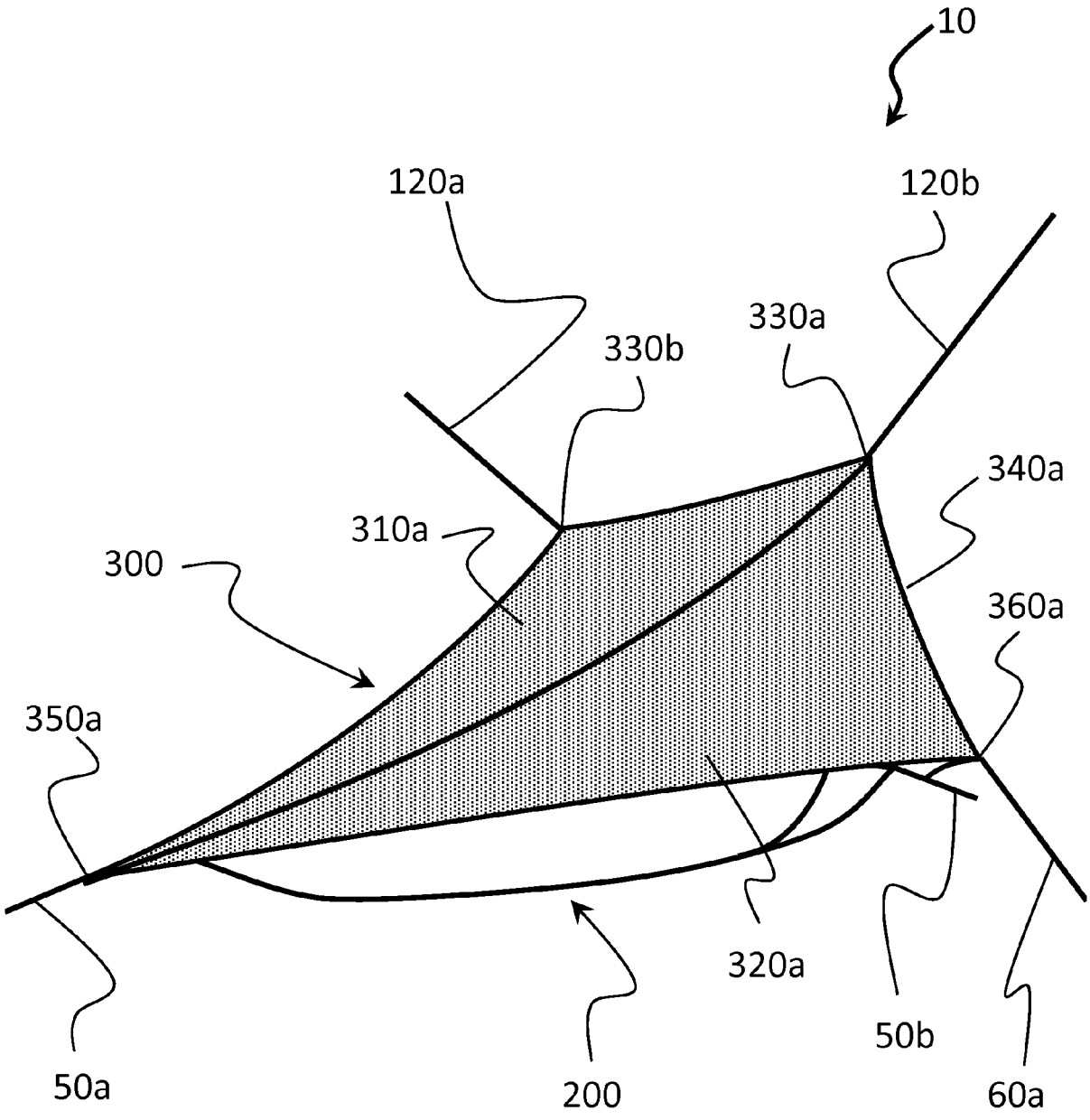
FIG. 6A is a perspective view of the hammock body and fly of FIG. 1.
Figure 6B:
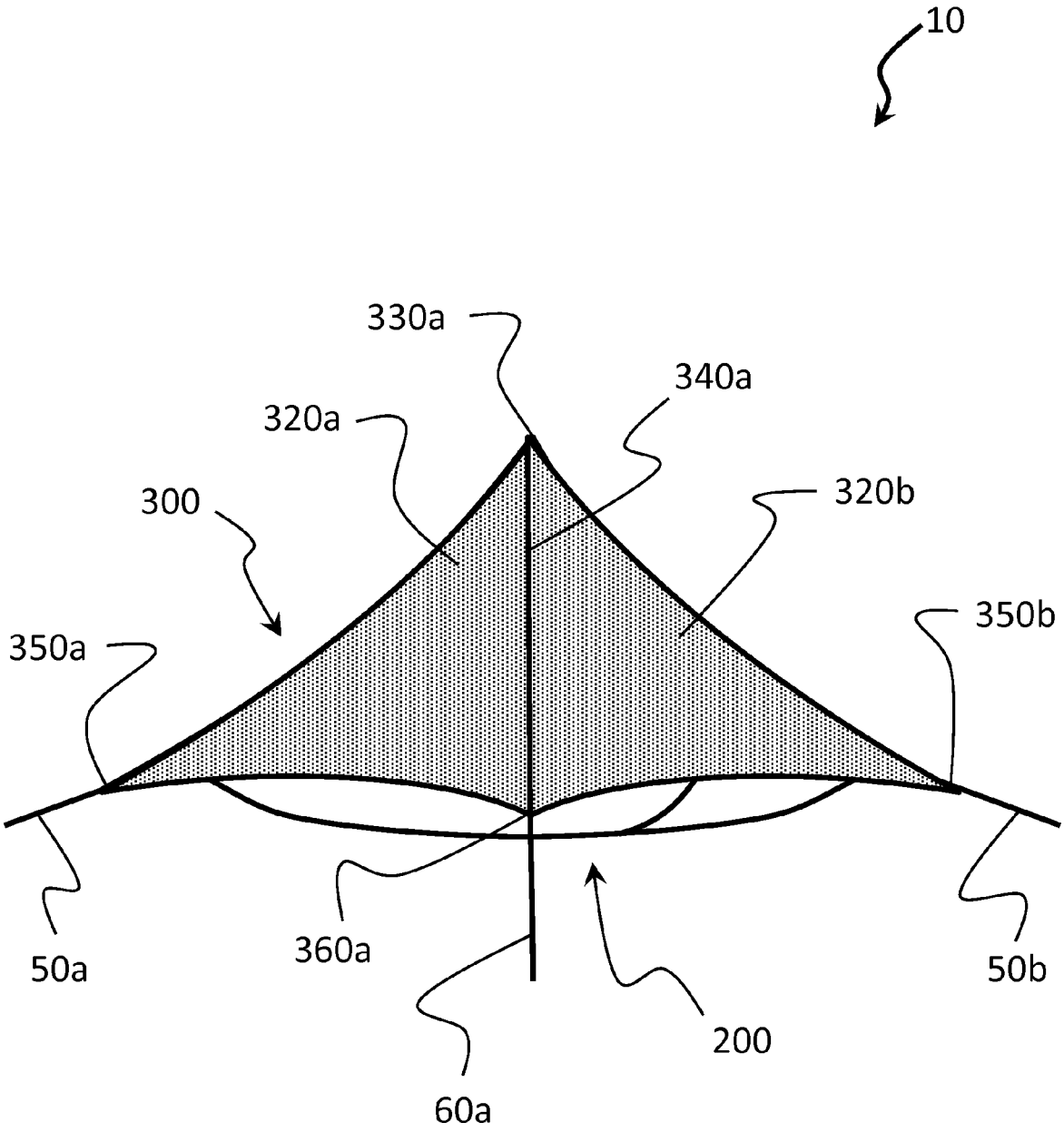
FIG. 6B is a side elevation view of the hammock body and fly of FIG. 6A.
Figure 6C:
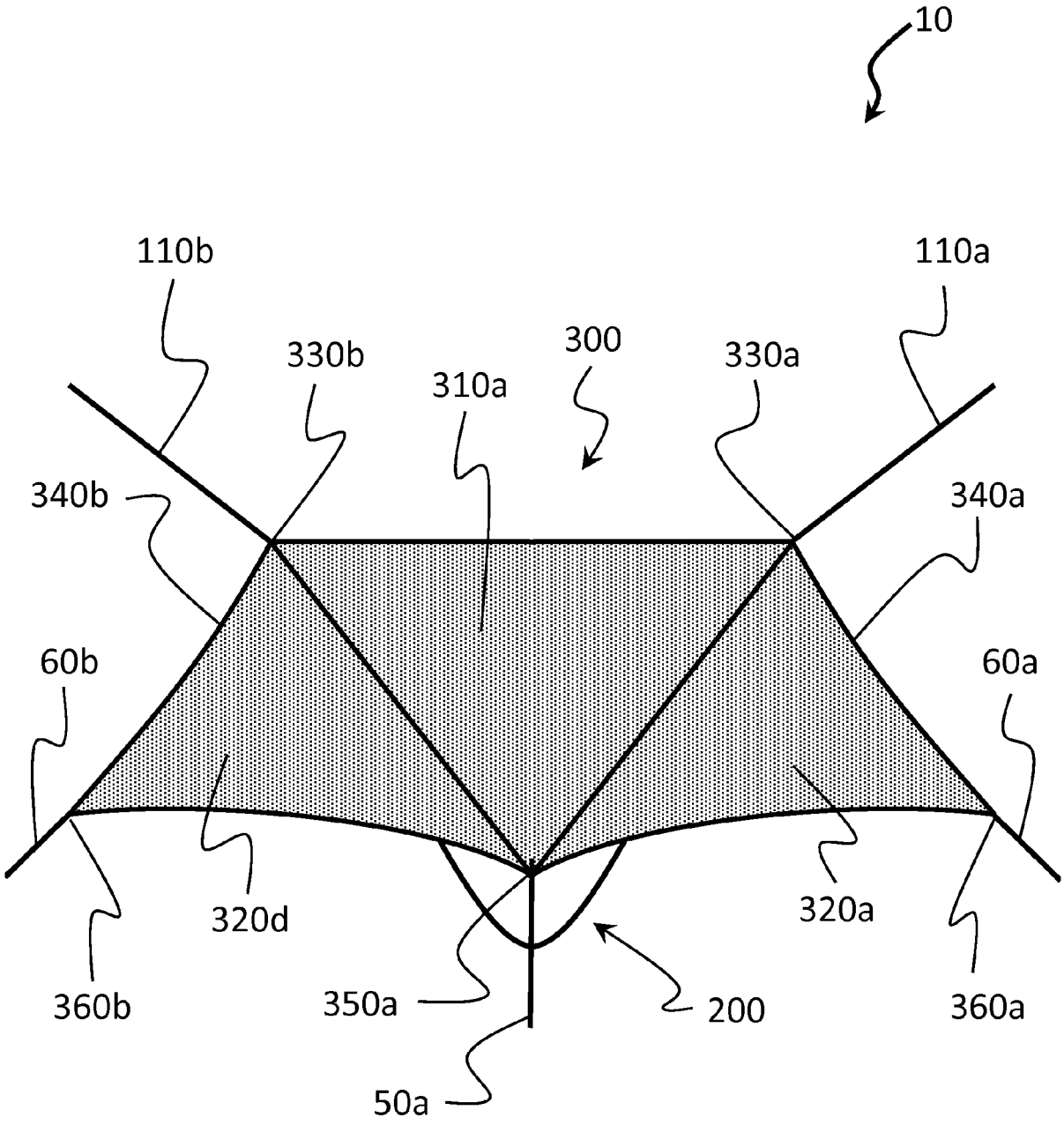
FIG. 6C is a front elevation view of the hammock body and fly of FIG. 6A.
Figure 6D:
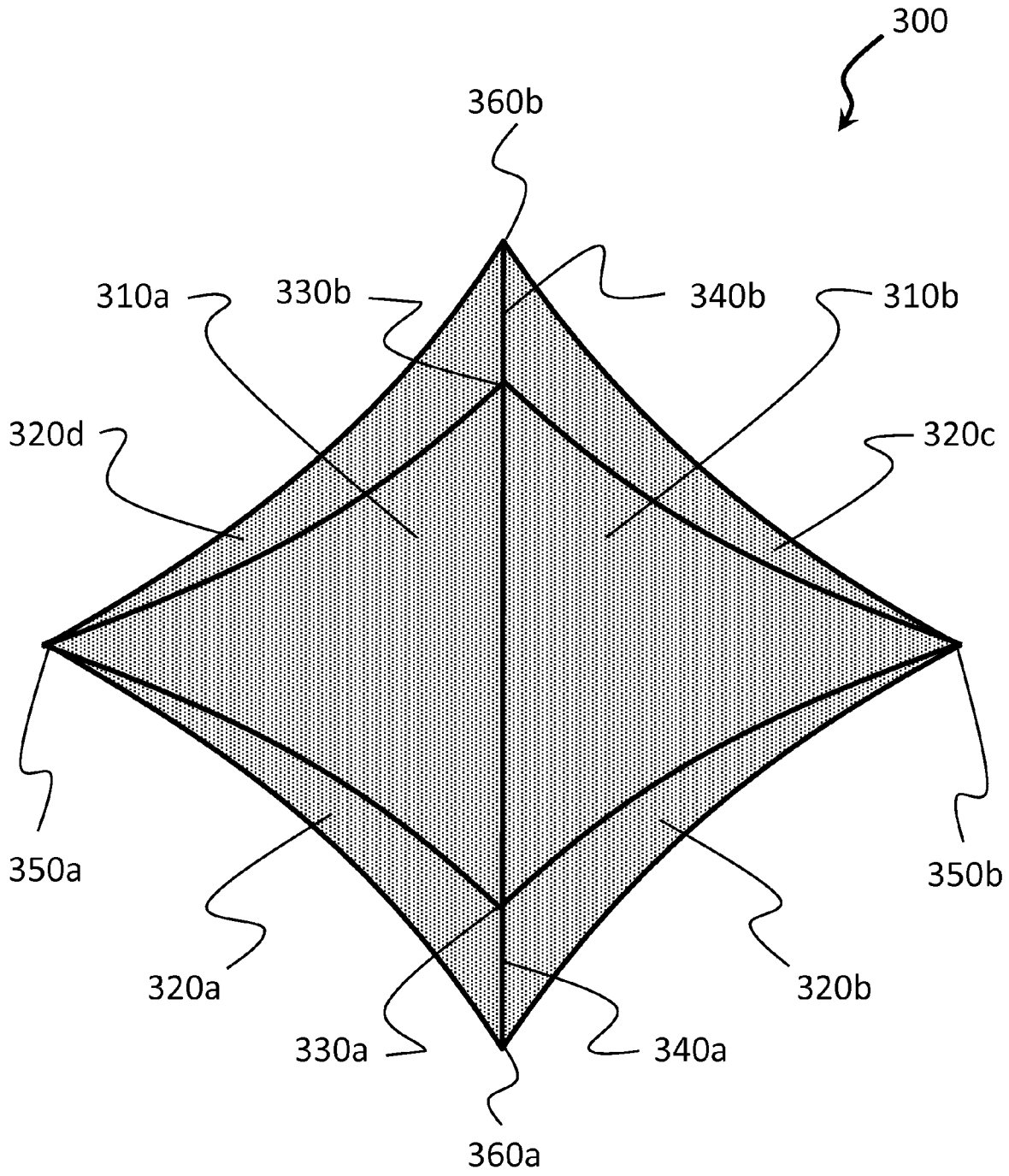
FIG. 6D is a top view of the hammock body and fly of FIG. 6A.

Body panels 210*a* and 210*b*, as shown in FIG. 5, preferably approximate an isosceles triangle in shape and are defined by edges 212*a*, 212*b*, and the edge largely created by edges 214*a*, 214*b*, and 216, with edges 212*a* and 212*b* being of equal length. In this embodiment, body panels 210*a* and 210*b* are preferably made from uncoated 40D ripstop nylon fabric oriented such that between notch 218 and edge 216 the material is on a bias and edges 212*a* and 212*b* are generally parallel and perpendicular to the warp and weft. While 40D ripstop nylon is described above, any sufficiently strong, waterproof or non-waterproof, breathable or non-breathable, woven or nonwoven material would work, such as Tyvek®, polyurethane, or silicone-coated ripstop or taffeta nylon, polyester, neoprene, vinyl, cotton, or commonly available waterproof breathable materials such as HyVent®, or laminates such as Cuben Fiber. Ripstop nylon is a woven fabric created with non-elastic threads that stretches along its bias. With the material in body panels 210*a* and 210*b* oriented as described, when a user enters body 200 there will be significant stretch in the direction between notch 218 and edge 216 and substantially no stretch along edges 212*a* and 212*b*. While in this embodiment body panels 210*a* and 210*b* are each constructed from a single section of fabric, it should be understood that an approximate equivalents to these two panels may constructed by one or more pieces of fabric attached along the bias or non-bias orientation.

Having edge 216 in line with edges 214*a* and 214*b* would create a concaved sleeping surface within body 200 when a user lies down parallel to edge 216 due to the stretch along the bias and reduced stretch along edges 212*a* and 212*b*. Lying on a curved surface for extended periods, such as when a user sleeps, leads to discomfort in joints and muscles, specifically in the lower back. Further discomfort is experienced by those individual who typically sleep on their stomach or side as it is impossible to comfortably sleep in these positions on such a curved surface. In this embodiment edges 214*a* and 214*b* extended beyond edge 216 by approximated 36 inches, curve to meet edges 212*a* and 212*b* at a right angle and are both approximately the same length as edge 216. Extending edges 214*a* and 214*b* below edge 216 lowers the floor area towards the ends of the sleeping surface within body 200 while not affecting the height of the central sleep surface created where edges 216 of body panels 210*a* and 210*b* meet. The gradual transition between edge 216 and edges 214*a* and 214*b* creates no points of discomfort when a user lies down. The substantially right angle intersection of edge 212*a* with edge 214*a*, and edge 212*b* with edge 214*b* provides a twofold improvement over intersecting at an angle that would otherwise be created if edges 214*a* and 214*b* continued outward and in line with edge 216. The first benefit is that the length from end to end of body panels 210*a* and 210*b* is reduced with a minimal decrease in the internal volume of body 200. This decreased length reduces the amount of materials required, thus reducing the cost and weight of the body 200, and reduces the amount of room required when setting up hammock 10. The second benefit is that the amount of space around the users head when lying down is significantly increased without increasing the length of body 200. As mesh 220 tapers downward when approaching mounting points 250*a* and 250*b*, the curved pattern and substantially right angle connection or edges 214*a* and 214*b* to edges 212*a* and 212*b* provides more space around the users head when lying down thereby reducing the feeling of claustrophobia and creates a more pleasant user experience.

Notch 218 is preferably located where edges 212*a* and 212*b* generally intersect and is created by removing a generally square section of material approximately 12 inches in edge length. The two edges created by this notch are sewn together to create a vertex where clip 245 is attached. By creating this notch and sewing as described, a portion of body panels 210*a* and 210*b* are angled away from the plane of the body panel. This reduces the amount of material required to enclose body 200 thereby reducing the cost and weight of material while only minimally decreasing the amount of interior space. Notch 218 may be located at an equal distance from the other two corners, or may be offset to compensate for the non-uniform weight distribution of the human body. As the upper half of a human weights more than the bottom half, this causes the end of the hammock supporting the upper half of the body to sag lower than the rest. By offsetting notch 218 to be closer to the head end of the hammock, this sag can be compensated for.

Mesh 220 preferably encloses the opening created between body panels 210*a* and 210*b* by attaching to edges 212*a* and 212*b* of body panels 210*a* and 210*b*. In this embodiment mesh 220 is formed from a single piece of no-see-um nylon mesh to provide protection against insects while allowing airflow and the ability to see out. While mesh 220 is formed from a single piece of material in this embodiment, one or more pieces of fabric attached together may be used. Mesh 220 may be attached to body panels 210*a* and 210*b* by a sewn seam, hook and loop, zipper, or combination thereof.

As body panels 210*a* and 210*b* and mesh panel 220 create an enclosed structure, door 230 (FIG. 4B) is provided to allow users to access the inside. In this embodiment door 230 preferably uses a single 60 inch long nylon coil type zipper. The first end of door 230 preferably commences approximately 8 inches in from the center of edge 212*b* of body panel 210*a* and preferably terminates approximately 8 inches in from the center of edge 212*b* of body panel 210*b*. The door 230 preferably extends away from its commencement point perpendicularly from edge 212*b* of body panel 210*a* where it curves towards the end of edge 216 nearest the door, passes perpendicularly through the point where edges 216 and 214*b* of body panels 210*a* and 210*b* meet, curves towards the middle of the edge 212*b* of body panel 210*b*, where it extends linearly in a path perpendicular to edge 212*b* of body panel 210*b* to the pointer where the door terminates. Door 230 is preferably oriented in this way as there is little tension in the fabric at these locations when the user is inside of body 200, as well as for ease of access to users entering and exiting body 200. While a nylon coil zipper is described, alternative materials such as polyester or metal, zipper construction such as formed tooth, or other types of temporary fastening, such as hook and loop, may be used.

Clips 245 located at either end of where the roofline of mesh 220 meets body panels 210*a* and 210*b* are preferably used to prevent mesh 220 from sagging, by attaching to rope 110 of suspension line 100. In this embodiment, clips 245 are small lightweight plastic hooks, although other temporary mechanical fasteners could be used and are not limited to buckles, hooks, hook and loop, ties, cord, wire, etc.

Mounting points 250*a* and 250*b* are used to connect to guy-ropes 50*a* and 50*b*, respectively, and each preferably comprises a reinforcement panel and quick release buckle connected by a short length of webbing (not shown). Connectors 240*a* and 240*b* are preferably located at the inside corner of notch 218 of body panels 210*a* and 210*b*, respectively, opposite the edge where body panels 210*a* and 210*b* attach, respectively. Connector 240*a* preferably comprises a 6 inch length of 1 inch wide nylon webbing, with one end attached to body 200 using suitable reinforcements, and the other end preferably comprises a mechanical fastener compatible with connectors 140*a* and 140*b* of suspension line 100. Similarly, connector 240*b* preferably comprises a 6 inch length of 1 inch wide nylon webbing, with one end attached to body 200 using suitable reinforcements, and the other end preferably comprises a mechanical fastener compatible with connectors 140*a* and 140*b* of suspension line 100. In this embodiment, the mechanical fasteners used in connectors 240*a* and 240*b* may comprise simple loops made by folding the webbing back on itself and sewing a bar tack. Alternatively, connectors 240*a* and 240*b* could be synthetic or metal quick release buckles, hooks, d-rings, carabineers, or any other suitable means for quickly and securely creating temporary connections, so long as mounting points 140*a*, 140*b* and line openings 330*a* and 330*b* are compatible. Alternatively, mounting points 140*a* and 140*b* may be permanently affixed to the point on body 200 in which connectors 240*a* and 240*b* are fastened.

By attaching connectors 240*a* and 240*b* to only a single point on body panels 210*a* and 210*b*, respectively, the weight of the user is spread evenly through the body panels and no high pressure areas are created. Although multiple connectors used on each of body panels 210*a* and 210*b*, could be used, they may create bands of increased tension across the sleeping surface of body 200, perhaps causing some discomfort to the user.

Turning now to FIGS. 6A through 6D, fly 300 will be described in greater detail. Fly 300 preferably comprises top panels 310*a* and 310*b*, side panels 320*a*, 320*b*, 320*c*, and 320*d*, line openings 330*a* and 330*b*, zippers 340*a* and 340*b*, end guy mounts 350*a* and 350*b*, side guy mounts 360*a* and 360*b*, and guy ropes 60*a* and 60*b*. When attached to suspension line 100 and guy ropes 50*a*, 50*b*, 60*a* and 60*b*, the fly 300 provides protection from precipitation, sun and wind, to the body 200, and the user and the user's equipment inside body 200. In this embodiment, top panels 310*a* and 310*b*, and side panels 320*a*, 320*b*, 320*c*, and 320*d* are preferably made from 30D silicone impregnated ripstop nylon because of its outstanding durability and water resistance, although any sufficiently lightweight, waterproof or waterproof-breathable, woven or nonwoven material could be used, such as Tyvek®, polyurethane or silicone impregnated ripstop or taffeta nylon, polyester, neoprene, vinyl, cotton, or commonly available waterproof breathable materials such as HyVent®, or laminates such as Cuben Fiber.

Top panel 310*a* is preferably generally triangular in shape and defined by vertices at openings 330*a* and 330*b*, and end guy mount 350*a*. Similarly, top panel 310*b* is preferably generally triangular in shape and defined by vertices at openings 330*a* and 330*b*, and end guy mount 350*b*. In this embodiment, top panels 310*a* and 310*b* are preferably two separate panels connected along the edge created between openings 330*a* and 330*b*, although top panels 310*a* and 310*b* may be constructed from one or more sections of fabric. Side panel 320*a* is generally triangular in shape and is defined by vertices at opening 330*a*, end guy mount 350*a*, and side guy mount 360*a*. Side panel 320*a* is preferably connected to top panel 310*a* along the edge between opening 330*a* and end guy mount 350*a*, and connected to zipper 340*a* along the edge between opening 330*a* and side guy mount 360*a*. Side panel 320*b* is also preferably generally triangular in shape and defined by vertices at opening 330*a*, end guy mount 350*b*, and side guy mount 360*a*. Side panel 320*b* is preferably connected to top panel 310*b* along the edge between opening 330*a* and end guy mount 350*b*, and is preferably connected to zipper 340*a* along the edge between opening 330*a* and side guy mount 360*a*. Side panel 320*c* is also preferably generally triangular in shape and defined by vertices at opening 330*b*, end guy mount 350*b*, and side guy mount 360*b*. Side panel 320*c* is preferably connected to top panel 310*b* along the edge between opening 330*b* and end guy mount 350*b*, and connected to zipper 340*b* along the edge between opening 330*b* and side guy mount 360*b*. Side panel 320*d* is also preferably generally triangular in shape and defined by vertices at opening 330*b*, end guy mount 350*a*, and side guy mount 360*b*. Side panel 320*d* is preferably connected to top panel 310*a* along the edge between opening 330*b* and end guy mount 350*a*, and connected to zipper 340*b* along the edge between opening 330*b* and side guy mount 360*b*. In this embodiment, side panels 320*a*, 320*b*, 320*c*, and 320*d* are all the same shape and size and connected to top panels 310*a* and 310*b*, and zippers 340*a* and 340*b* using well known fabric welding techniques, although different sizes, shapes, and well known connection methods, such as stitching and thermal bonding, may be used. The distances between the middle point of line openings 330*a* and 330*b* to guy mounts 350*a* and 350*b*, respectively, are such that they preferably extend beyond mounting points 250*a* and 250*b* when installed. This larger size provides body 200 with additional protection from rain. Side panels 320*a*, 320*b*, 320*c* and 320*d* are preferably shaped such that when guy ropes 60*a* and 60*b* are attached to anchor points A5 and A6, respectively, the sides of fly 300 are sloped down and outwards between an angle of 10 and 60 degrees from vertical. In this embodiment, the sides of fly 300 are preferably angled outwards at 45 degrees from vertical.

To create a taut surface throughout fly 300, the warp or weft of top panels 310*a* and 310*b* are preferably oriented such that they are generally parallel and perpendicular to the edge between openings 330*a* and 330*b*, and the warp or weft of side panels 320*am* 320*b*, 320*c* and 320*d* are preferably oriented such that they are generally parallel or perpendicular to the edge between the side and end guy mounts of the panel. To further aid in creating a taut surface throughout fly 300, the edges connecting top panels 310*a* and 310*b* with side panels 320*a*, 320*b*, 320*c* and 320*d* are preferably curved inwards by between 2 and 12 inches.

Line openings 330*a* and 330*b* allow ropes 120*a* and 120*b* to pass through the upper surface of fly 300 and, in conjunction with zippers 340*a* and 340*b*, allow the fly to be installed on suspension line 100 either before or after connectors 240*a* and 240*b* of body 200 have been attached to connectors 140*a* and 140*b* of suspension line 100. This provides the user with flexibility and ease of setting up fly 300 by not requiring body 200 to be attached to suspension line 100. Zipper 340*a* attaches to both side panels 320*a* and 320*b* and runs from side guy mount 360*a* to line opening 330*a*. Similarly, zipper 340*b* attaches to both side panels 320*c* and 320*d* and runs from side guy mount 360*b* to line opening 330*b*. Both zippers 340*a* and 340*b* are separating type zippers to allow ropes 120*a* and 120*b* to reach openings 330*a* and 330*b* when unfastened. In this embodiment zippers 340*a* and 340*b* are waterproof nylon zippers, although other closures types and materials may be used, such as those described above. Openings 330*a* and 330*b* are positioned at the end of zippers 340*a* and 340*b* opposite side guy mounts 360*a* and 360*b*, respectively, and are simply openings between the side panels to allow ropes 120*a* and 120*b* to remain in place once the zippers 340*a* and 340*b* are fastened, and may include a means to prevent water from traversing from the outer surface of fly 300 through line openings 330*a* and 330*b* onto the underside of fly 300. Such means to prevent water from traversing through holes 330*a* and 330*b* may include gasket material, such as rubber, silicon or neoprene, a flap, or other suitable means.

Side guy mounts 360*a* and 360*b* are preferably positioned opposite line openings 330*a* and 330*b* on zippers 340*a* and 340*b*, and preferably connect to guy ropes 60*a* and 60*b*, respectively. In this embodiment, side guy mounts 360*a* and 360*b* preferably comprise a reinforced material and a loop made from ½ inch nylon webbing such that guy ropes 60*a* and 60*b* may easily attach.

End guy mounts 350*a* and 350*b* are preferably positioned at the corners opposite line openings 330*a* and 330*b* on top panels 310*a* and 310*b*, respectively. In this embodiment, end guy mounts 350*a* and 350*b* preferably comprise a reinforced material, preferably a loop made from ½ inch nylon webbing attached to a half of a quick release plastic buckle such that guy ropes 50*a* and 50*b* may easily attach.

Guy ropes 50*a*, 50*b*, 60*a* and 60*b* preferably connect about anchor points A3, A4, A5, and A6, respectively. Guy ropes 50*a* and 50*b* are preferably substantially identical in construction and can be used interchangeably; such is the case with guy ropes 60*a* and 60*b*. Guy rope 50*a* preferably attaches to both mounting point 250*a* on body 200 and guy mount 350*a* on fly 300. Guy rope 50*b* preferably attaches to both mounting point 250*b* on body 200 and guy mount 350*b* on fly 300. Guy ropes 50*a* and 50*b* are preferably anchored about anchor points A3 and A4, respectively, and used to pull the end of body 200 and fly 300 outwards from the vertical plane of suspension line 100 and anchors A1 and A2, thus providing an interior volume and substantially flat sleeping surface in body 200, as well as creating a taut surface over fly 300 to aid in repelling water by preventing pooling and displacement during windy periods. Guy rope

60*a* preferably attaches to guy mount 360*a* and is anchored about anchor point A5. Guy rope 60*b* preferably attaches to guy mount 360*b* and is anchored about anchor point A6. Guy ropes 60*a* and 60*b* pull the corners of side panels 320*a*, 320*b*, 320*c*, and 320*d* outward to create a taut fly surface. In this embodiment, guy ropes 50*a*, 50*b*, 60*a*, and 60*b* are preferably made from 1 mm Dyneema cord due to the light weight, high strength, and low stretch characteristics, and preferably includes plastic quick release buckles to create an easily releasable connection at mounting points 250*a* and 250*b*, and guy mounts 350*a*, 350*b*, 360*a*, and 360*b*. Guy ropes 50*a*, 50*b*, 60*a*, and 60*b* also preferably include means for creating a secure and easily releasable connection about anchor points A3, A4, A5, and A6. While plastic quick release buckles are described as being used, many different types of temporary and sufficiently secure fasteners may be used, such as a hook, snap hook, or carabineers. Alternatively, guy mounts 350*a* and 350*b* each may comprise a plastic hook which attaches to a Prusik knot located on guy lines 50*a* and 50*b*. Similarly, each line opening 330*a* and 330*b* may comprise a plastic hook which attaches to a Prusik knot located on ropes 120*a* and 120*b*.

Alternatively, fly 300 may omit zippers 340*a* and 340*b* by instead permanently fasten the side panels together and adding a nylon webbing loop over each of line openings 330*a* and 330*b*. Then, to attach the fly to suspension line 100, the nylon webbing loops are looped around connectors 140*a* and 140*b*, and connectors 240*a* and 240*b* of body 200 are connected to connectors 140*a* and 140*b* through line openings 330*a* and 330*b*. This embodiment may make it difficult for the user to attach fly 300 to suspension line 100 when body 200 is already suspended, but removing the zippers makes the fly simpler to construct, lighter, and less expensive. Alternatively, a fly with no side panels may be used. This would offer the user a lighter weight solution while reducing protection from precipitation and wind.

Figure 7:
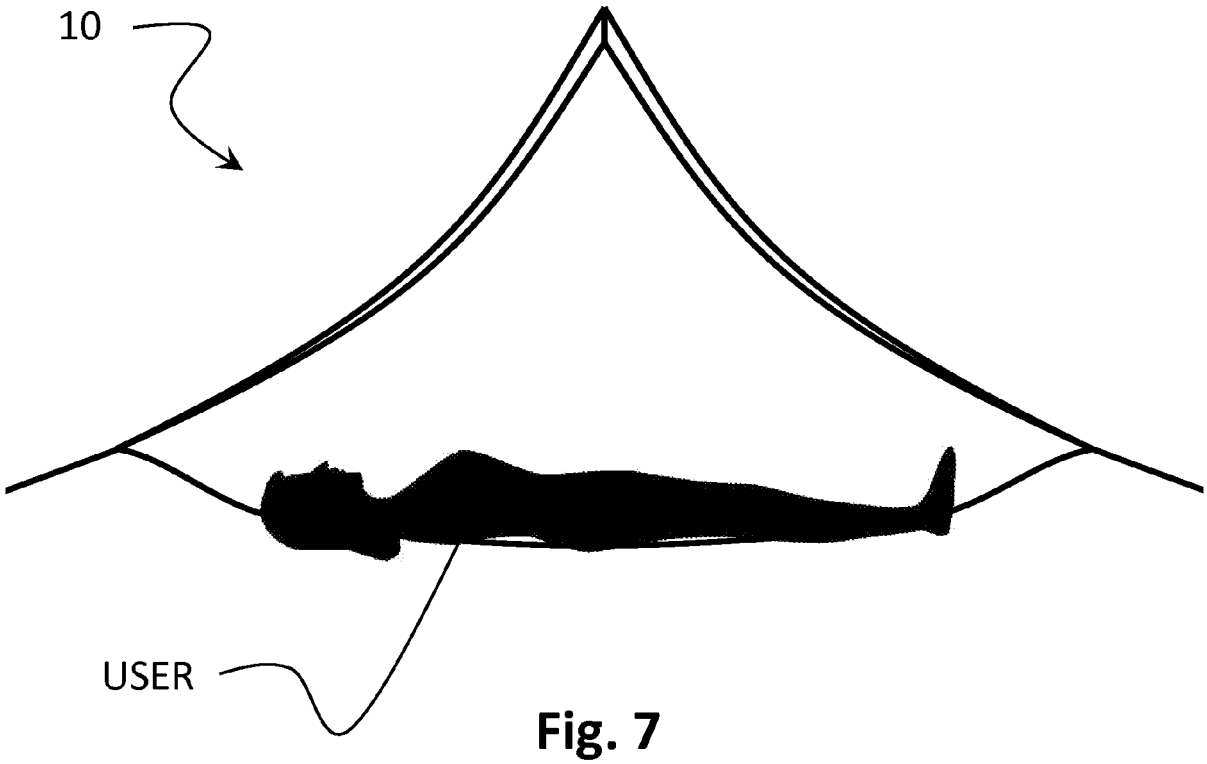
FIG. 7 is a side cross-sectional view of a user lying on the substantially flat surface of the hammock body of FIG. 4A.
Figure 8:
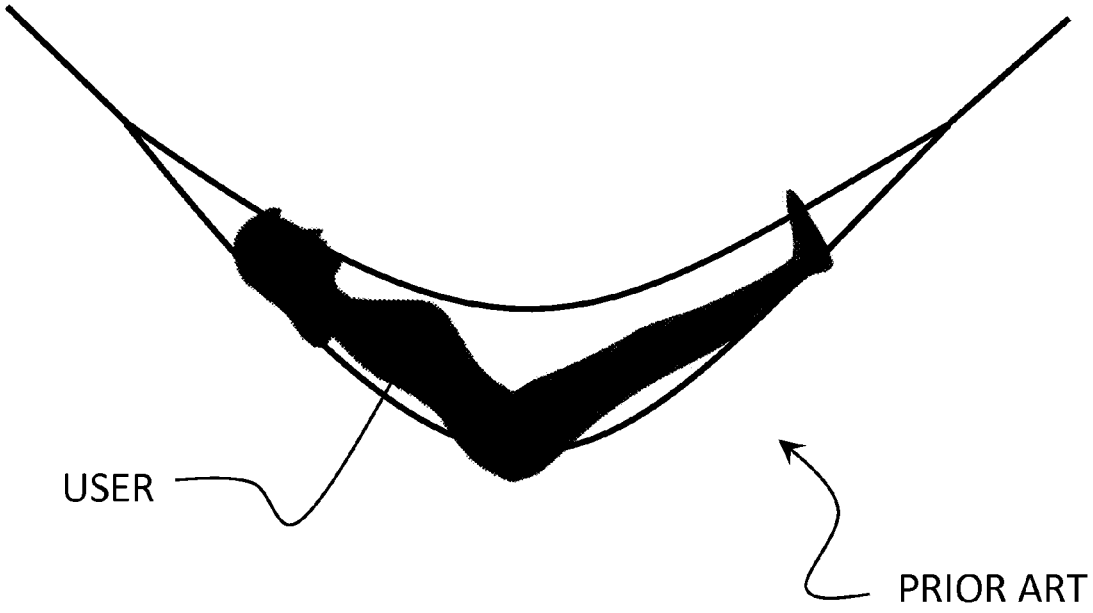
FIG. 8 is a side cross-sectional view of a user lying on the non-flat surface of a prior art hammock.

FIG. 7 shows the side profile of a user laying within hammock 10 while FIG. 8 shows the side profile of a user laying within a prior art hammock. As can be seen, the user in hammock 10 is lying in a substantially horizontal posture while the user of the prior art hammock is lying in a bent posture. While using prior art hammocks can be comfortable for short periods, during long periods, such as sleeping at night, a bent posture can lead to muscle and joint discomfort, as well as preventing users from assuming their preferred sleep position, such as lying flat on their back, stomach or side. Hammock 10 overcomes the shortfalls of prior art hammocks by allowing users to lie in a substantially flat position that is more analogous to sleeping on a bed and is comfortable for users to sleep on their back, side or stomach. Previous attempts to overcome this problem with prior art hammocks have included the use of a rigid frame incorporated around the sleeping surface. While this may create a substantially flat sleep surface, it requires the use of large and heavy members for the frame which makes transportation of this setup more burdensome and therefore unappealing to users seeking lightweight and compact equipment.

Figure 9:
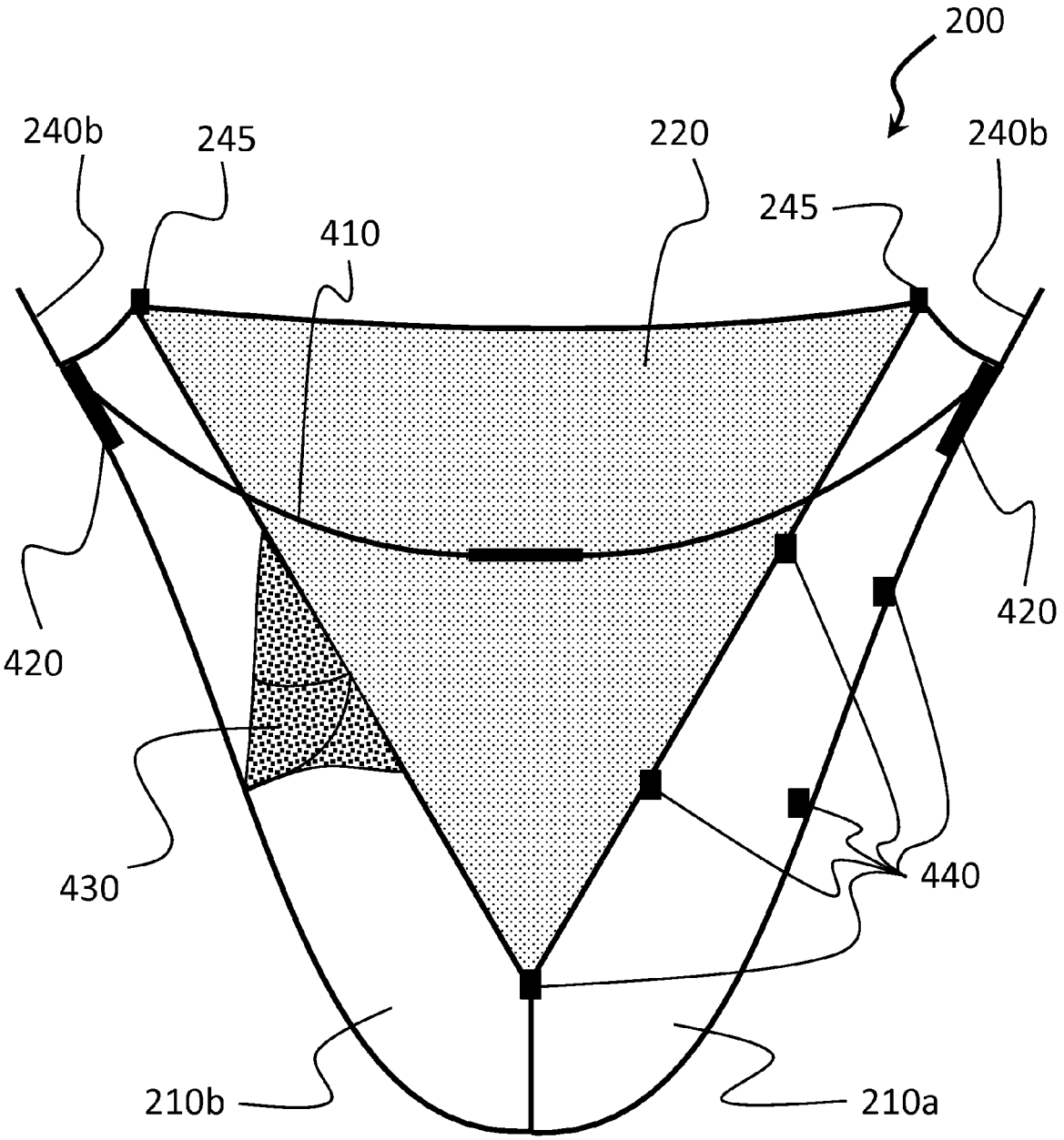
FIG. 9 is a front cross-sectional view of the interior of the hammock body of FIG. 1.
Figure 10A:
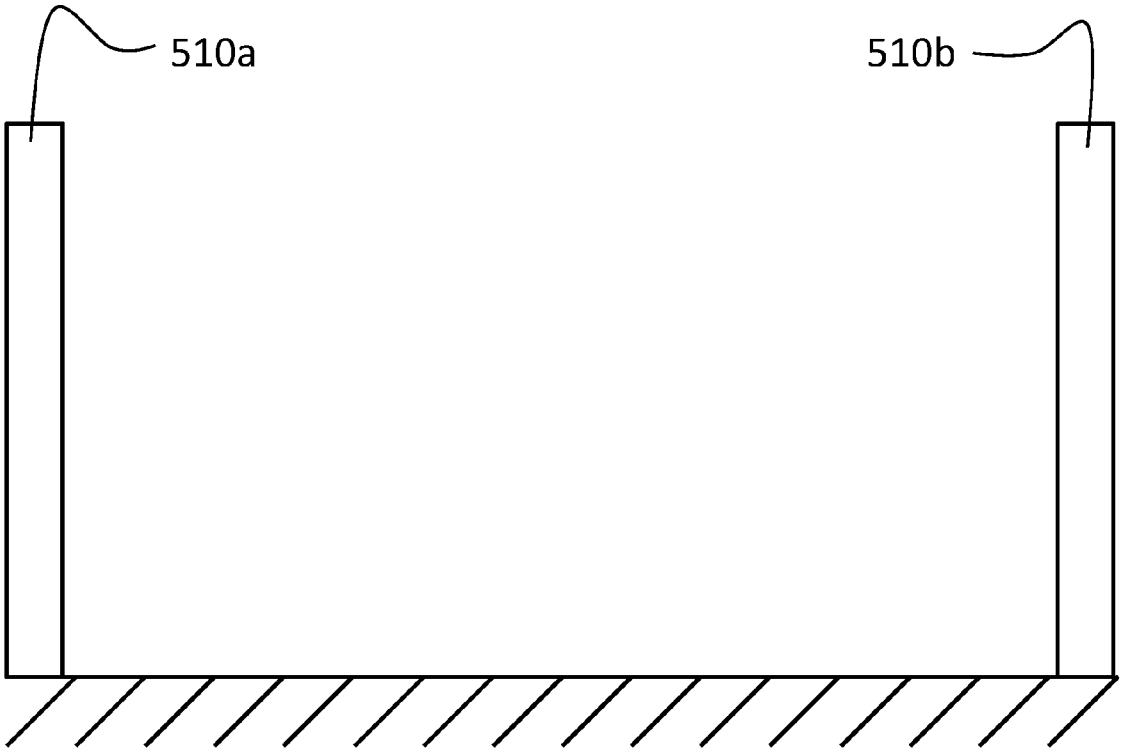
FIG. 10A is a schematic front elevation view of an area suitable to set up the hammock of FIG. 1.
Figure 10B:
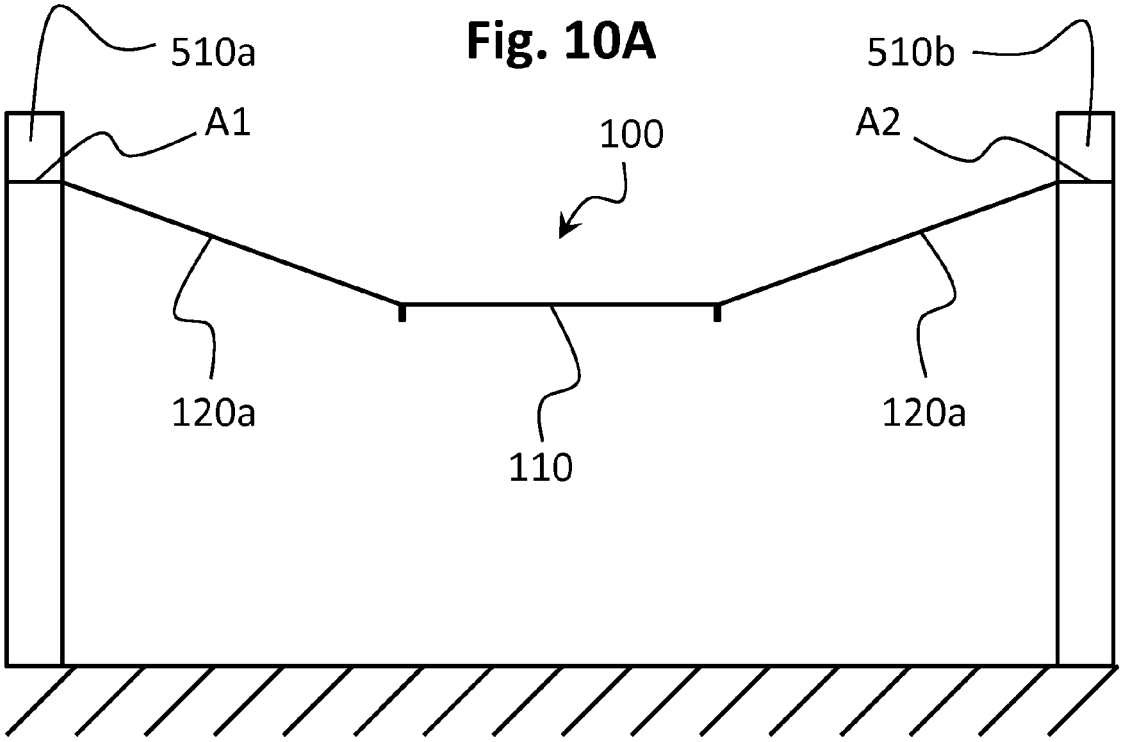
FIG. 10B is a schematic front elevation view of the suspension line of FIG. 2 set up in the area of FIG. 10A.
Figure 10C:
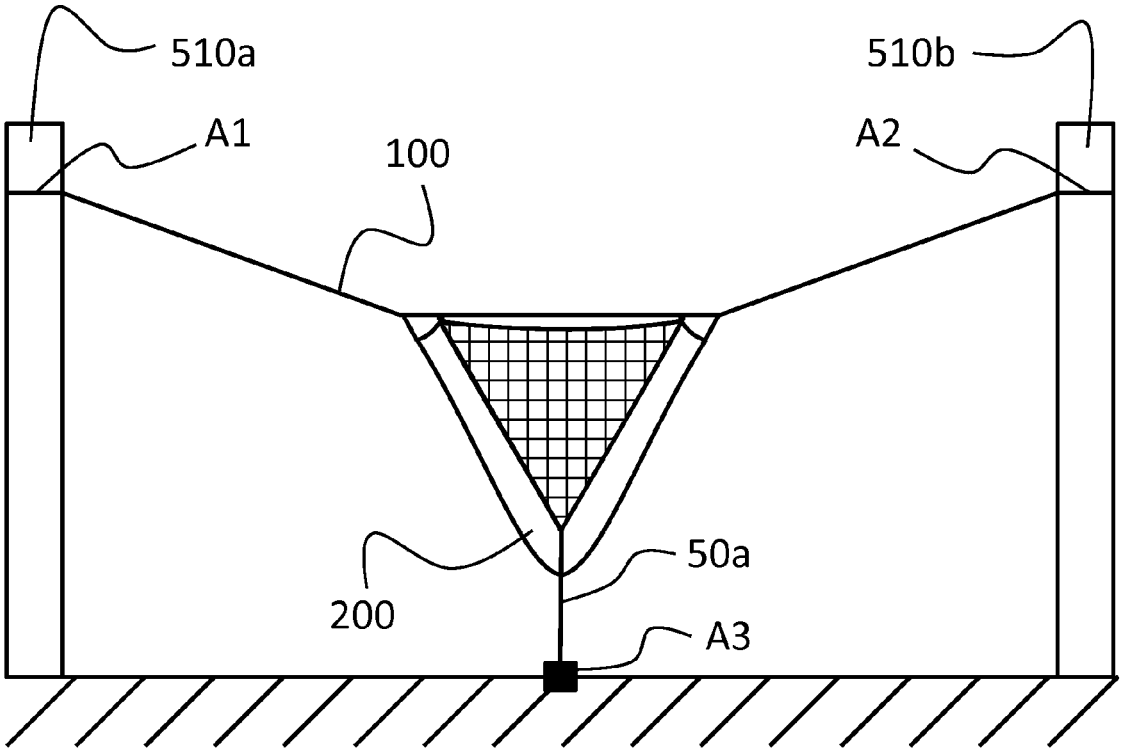
FIG. 10C is a schematic front elevation view of the body of FIG. 4 suspended from the suspension line of FIG. 2 in the area of FIG. 10A.
Figure 10D:
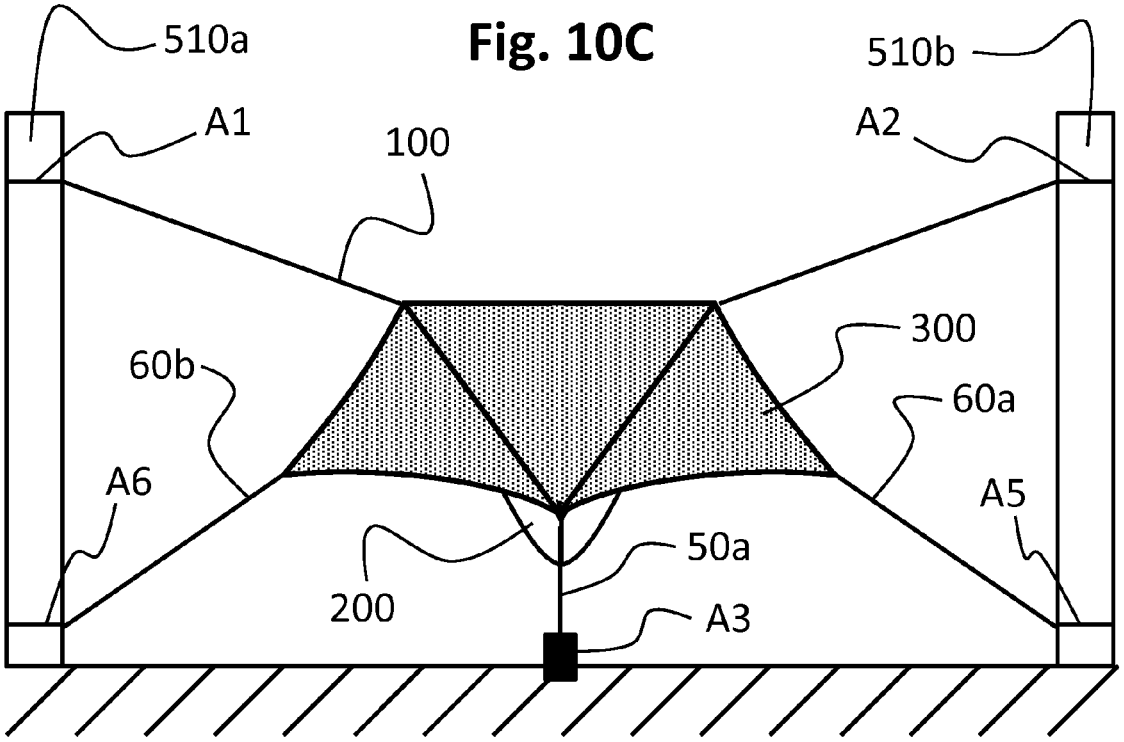
FIG. 10D is a schematic front elevation view of the hammock of FIG. 1 set up in the area of FIG. 10A.

Hammock 10 also provides a much larger internal volume than prior art hammocks, allowing the user to store equipment, change their clothes, comfortably move around, and spend time within while not feeling confined. FIG. 9 shows elements inside of hammock 200 and includes grab line 410, gear hooks 420, storage area 430, and loops 440. Many of these elements are unique to the design of hammock 10 and are not able to be integrated with prior art hammocks or ground based tents, and therefore offer the user increased and previously unknown benefits. Grab line 410 is preferably constructed from a length of cord approximately the same length of rope 110 where it is affixed to the interior of body 200 to a suitable secure point where connectors 240*a* and 240*b* attach to body 200. Grab line 410 preferably includes a semi rigid sleeve approximately 6 inches in length that the rope passes through thus providing the user with a handle to grab and lift themselves to aid movement within body 200. In this embodiment, the rope is preferably made from 2 mm Dyneema cord, and the sleeve is preferably made from ⅜" nylon tubing. Grab line 410 can also be used for hanging clothes and other items. Although the above described sleeve is preferably made from ⅜" nylon tubing, other materials, such as various plastics, metals, foams, silicon, tubular webbing, vinyl, or rubber (combined or not), or in a cast, injection-molded, or extruded shape, may be used. The handle of grab line 410 may also be suspended from the rope.

Gear hooks 420 are preferably connected to the same secure point as grab line 410, and provide the user with means to hang heavy items, such as a backpack or a water bladder, or other items, such as a jacket. In this embodiment, gear hooks 420 are preferably made from a 6 inch length of ½ inch nylon webbing attached to body 200 at one end and securely affixed to a lightweight carabineer (or other apparatus such as a snap hook, hook and loop, etc.) at the other. Storage area 430 preferably provides a means to stow additional items in a number of mesh pockets. In this embodiment, storage area 430 is preferably triangular in shape and preferably comprises a series of large and small mesh pockets that are located proximate the center of body panel 210*a*. This provides the user with ample storage spots that are protected from precipitation and sun while being highly accessible, and surpasses stowage available on prior art hammocks and most 2, 3, and 4 person tents. While in this embodiment a single storage area 430 is described, one or more storage areas may be present within body 200 and can be positioned at a variety of useable points, such as near the users head or along a seam.

Loops 440 are preferably small loops made by folding a short length of webbing in half and attaching them to a variety of seams and surfaces within body 200. In this embodiment there are 8 loops 440 preferably made from 4 inch lengths of ½ inch nylon webbing that are attached to the edges and surface of panel 210*a*. These loops provide the user with a number of points to attach ropes and clips as they desire as well as a means to temporarily attach additional accessories, such as pockets, mesh panels, clothes lines, grab lines, bags, lights, or gear slings.

Although only a few interior elements are described above, other interior elements, such as insulating bottom and/or top panels, built-in bottom foam panels, inflatable bottom and/or top panel members, sleeves, etc. may be used.

While only interior gear hooks, storage pockets, and loops are shown, the exterior of body 200 would also benefit from these elements are well. Gear hooks mounted to the outside surface opposite interior gear hooks 420 would allow the user to suspend heavier items on the outside, such as bags or clothing, which is convenient and particularly useful when these items are wet and not wanted inside body 200. Storage pockets on the exterior of body 200 would provide convenient storage of smaller and lighter items not needed inside, such as cooking related equipment. Another particularly useful exterior element would be a means to store the user's footwear proximate door 230 such that when the user enters body 200 they have somewhere to put their footwear so they may easily access them when they exit hammock 10. Such means for storing the footwear includes a bag, hook, a short length of hook and loop, or a short length of cord affixed to the exterior of body 200 at the opening end of the zipper of door 230.

Figure 15:
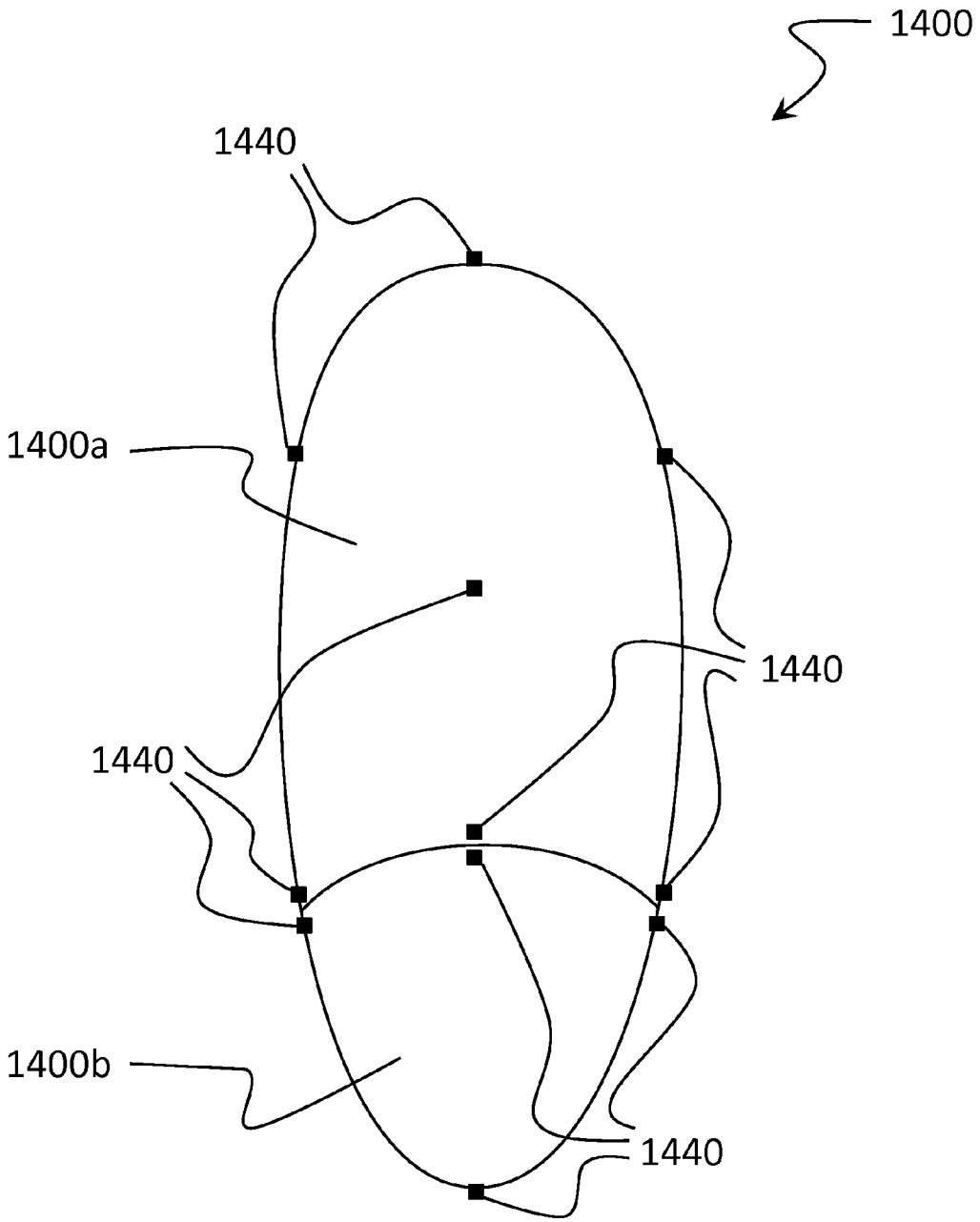
FIG. 15 is a top view of a sleeping pad for use with the hammock of FIG. 1.

In warm weather, body 200 provides a much cooler sleeping surface than a tent with a sleeping pad, because of the reduced insulation levels and greater convective heat transfer. However, in cooler weather this inherent cooling ability should be compensated for. The single piece sleeping pads that are well known in the art can be used within body 200, but may cause frustration to the user when entering and exiting body 200 through door 230, since the single piece sleeping pad covers a large portion of door 230 and extends beyond the door in both directions. Therefore, when the user enters body 200, the user must move the one piece sleeping pad away from the door, enter body 200, close door 230, and reposition the one piece sleeping pad yet again. Similarly when the user exits body 200 they must first move the one piece sleeping pad to expose door 230 before opening and exiting. This can be someone difficult as the sleeping pad is usually located beneath the user when they are within body 200. FIG. 15 shows a sleeping pad 1400 made from 0.5 inch closed-cell foam that is placed lengthwise within body 200 such that the user sleeps thereon. Sleeping pad 1400 comprises two sections, 1400*a* and 1400*b* and a plurality of clips 1440 and has an elongated oval shape, although other shapes such as rectangular or hexagon; having wider and narrower sections; and being symmetrical on one or more axes may be used. Closed-cell foam provides enough support and thermal insulation such that users do not completely flatten the sleeping pad thereby negating any insulating properties. Although 0.5 inch thick closed-cell foam is described, other materials and thicknesses may be used, such as open-cell foam, inflatable pads, foam-core inflatable pads, synthetic or down filled panels, or fleece; and ranging between 0.25 inches and 6 inches thick. Sections 1400*a* and 1400*b* are preferably individual components separated by an arced edge that matches the arc of door 230 such that when sleeping pad 1400 is placed within body 200 and secured using clips 1440 to loops 240 at matched locations, the arc of sleeping pad 1400 aligns with the arc of door 230. This enables the user to easily enter and exit body 200 through door 230 without the inconveniences associated with having to reposition a single piece sleeping pad. Clips 1440 are preferably small plastics clips that are able to secure sleeping pad 1400 to loop 240 and are attached to sections 1400*a* and 1400*b* by short sections of webbing. Loops 240 and clips 1440 are positioned at appropriate locations to prevent sleeping pad 1400 from shifting within body 200.

Figure 13:
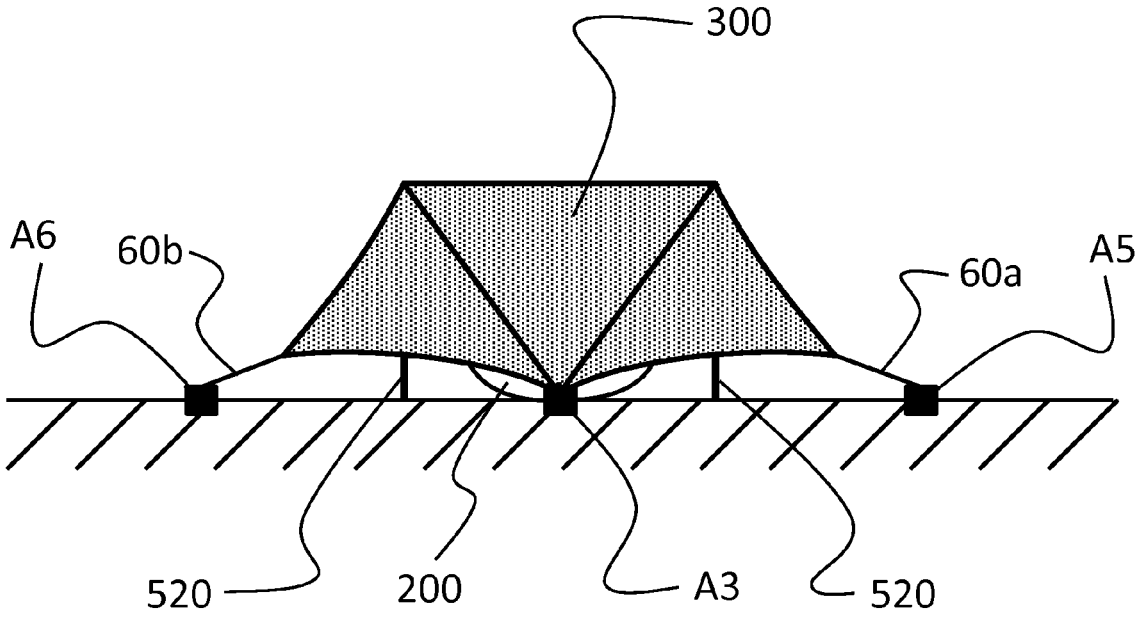
FIG. 13 is a schematic front elevation view of the hammock of FIG. 1 set up on the ground.

While sleeping pad 1400 is described as being placed on the interior surface of body 200, alternative embodiments where the sleeping pad is located on an exterior surface of body 200, within a sleeve between the interior and exterior of body 200, or integrally formed into body 200 may be used. An integrally formed inflatable sleeping pad would be particularly useful because of its simplicity, minimal weight addition, and it allows the user to choose when they want the thermal and comfort benefits of the inflated sleeping pad, such as in cooler weather, or when hammock 10 is used on the ground as depicted in FIG. 13.

Turning now to FIGS. 10A to 10D, setting up hammock 10 in the most common scenario will be described. Two support structures, 510*a* and 510*b*, that are sufficiently strong and separated by an acceptable distance are located. In this embodiment support structures 510*a* and 510*b* are living trees more than about 8 inches in diameter and spaced apart about 20 feet. Once a desired location is found, the user unpacks suspension line 100, affixes rope 120*a* about support structure 510*a* at anchor point A1, then affixes rope 120*b* about support structure 510*b* at anchor point A2. Ropes 120*a* and 120*b* are adjusted using tensions 130*a* and 130*b*, respectively, to adjust the height and position of connectors 140*a* and 140*b* so they are substantially level and hang between 5 and 7 feet above the ground. The user then unpacks body 200, attaches connectors 140*a* and 140*b* to mounting points 240*a* and 240*b* and attaches clips 245 to rope 110. Anchor points A3 and A4 are then placed in a position perpendicular to suspension line 100 at a distance of 10 to 20 feet and attached to body 200 using guy ropes 50*a* and 50*b*. In this embodiment anchor points A3 and A4 are one or more lightweight aluminum tent pegs, although any object capable of supporting a 100 lb horizontal load may be used, such as a the trunk of a tree; plastic, metal or composite tent pegs, a rock, a fallen tree or branch, or a bag filled with soil, sand, snow or rocks.

Fly 300 is then installed by placing the section between line openings 330*a* and 330*b* over line 110, closing zippers 340*a* and 340*b* so that lines 110*a* and 110*b* pass through line openings 330*a* and 330*b*, respectively, then anchoring end guy mounts 350*a* and 350*b* to anchor points A3 and A4 using guy ropes 50*a* and 50*b*, respectively, and anchoring side guy mounts 360*a* and 360*b* to anchor points A5 and A6 using guy ropes 60*a* and 60*b*, respectively. In this embodiment, anchor points A5 and A6 are the base of structures 510*a* and 510*b*, respectively, although they may be any object capable of supporting a 20 lb load, such as plastic, metal or composite tent pegs, a rock, a fallen tree or branch, or a bag filled with soil, sand, snow or rocks. If the user chooses to not install fly 300 and forego the rain and sun protection it offers, they may still use the rest of hammock 10 as described above.

While support structures 510*a* and 510*b* are described as being living trees 8 inches in diameter and spaced apart 20 feet, other structures such as sufficiently strong vertical structures may be used, such as living or structurally sound dead tree trunks and branches, boulders, rock faces, rafters, decks, pergolas, walls, light poles, flag poles, wooden or metal beams, and any other point which is able to support a load of several hundred pounds is acceptable.

Alternatively, the user may install fly 300 before installing body 200. This sequence is particularly useful when setting up in the rain and by installing fly 300 before body 200, allowing body 200 to remain dry and comfortable for the user. In this scenario, the user installs suspension line 100 as described above, then installs fly 300, attaches the end and side guy mounts to about anchor points A3, A4, A5, and A6, then installs body 200 as described above.

Figure 11:
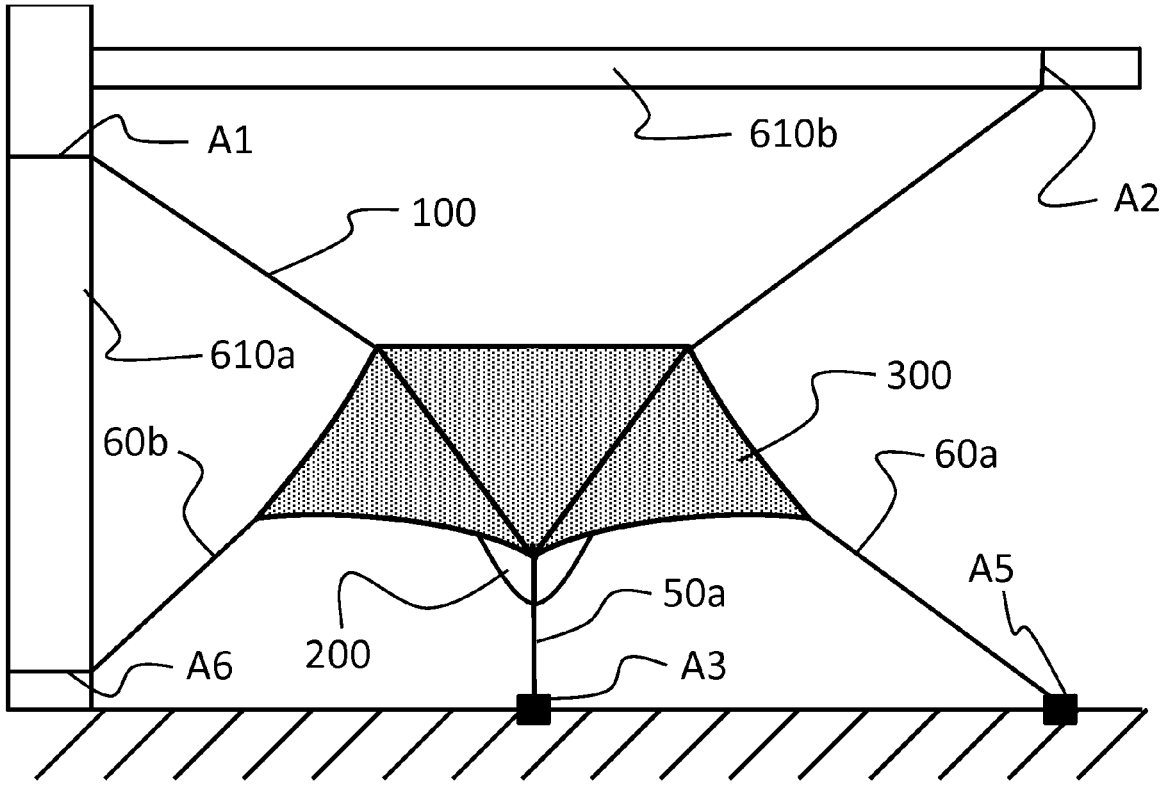
FIG. 11 is a schematic front elevation view of the hammock of FIG. 1 set up in an alternative area.
Figure 12:
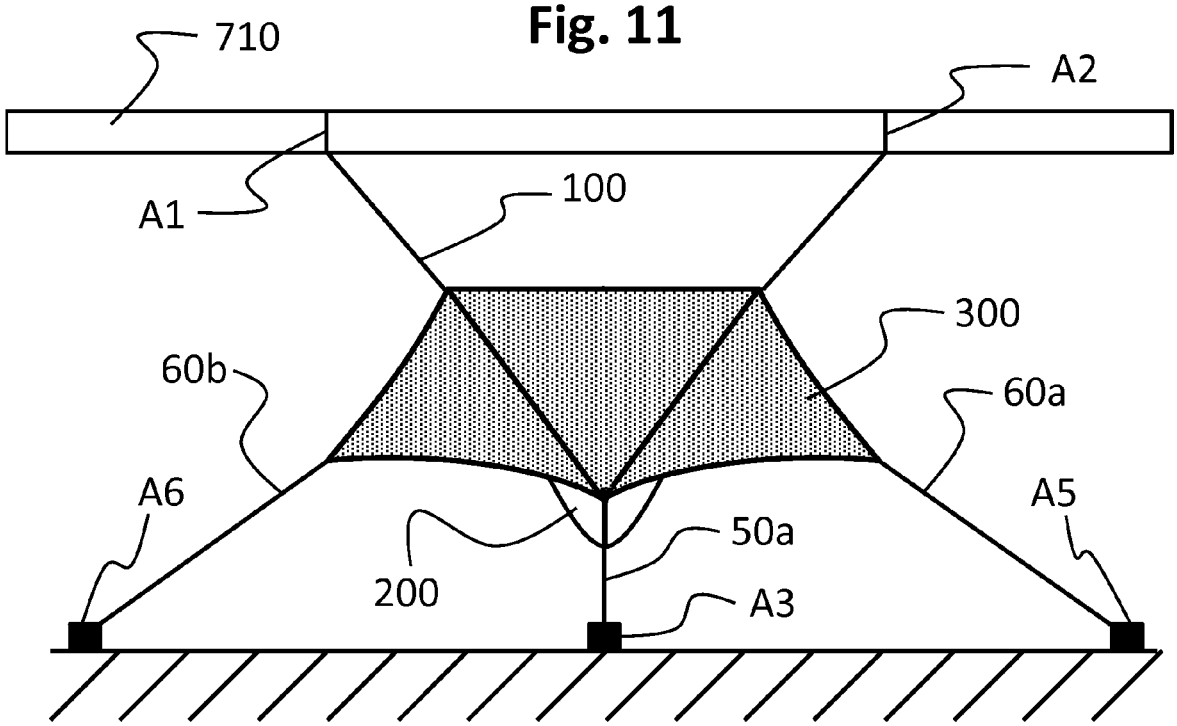
FIG. 12 is a schematic front elevation view of the hammock of FIG. 1 set up in an alternative area.

FIG. 11 shows hammock 10 installed using tree trunk 610*a* and branch 610*b*, and FIG. 12 shows hammock 10 installed using only a tree branch 710. In these installations, the suspension line 100, body 200, and fly 300 are each installed in a manner similar to that described above, by first attaching suspension line 100 about anchor points A1 and A2, then body 200 to suspension line 100 and anchor points A3 and A4, then fly 300 over suspension line 100 and to anchor points A3, A4, A5, and A6. Prior art hammocks could not be suspended in these situations and still provide a comfortable surface for a user to sleep in. While FIGS. 10, 11, and 12 describe three common scenarios of installing hammock 10, it should be understood that there are many other possible scenarios in which hammock 10 can be used.

When sufficient structural supports are unavailable, hammock 10 can still be used on the ground, as shown in FIG. 13. Here, body 200 partially rests on the ground and mounting points 240*a* and 240*b* are elevated by means of poles 520. In this embodiment poles 520 are hiking poles that are preferably 40 inches in length, although other lengths and pole types, such as wooden stick or branches, may be used. With mounting points 240*a* and 240*b* elevated on poles 520, mounting points 250*a* and 250*b* are anchored outwards using anchor points A3 and A4, creating an internal volume for the user to use. Fly 300 is then draped over body 200 and guyed out using anchor points A3, A4, A5, and A6 as described in previous embodiments.

Figure 14:
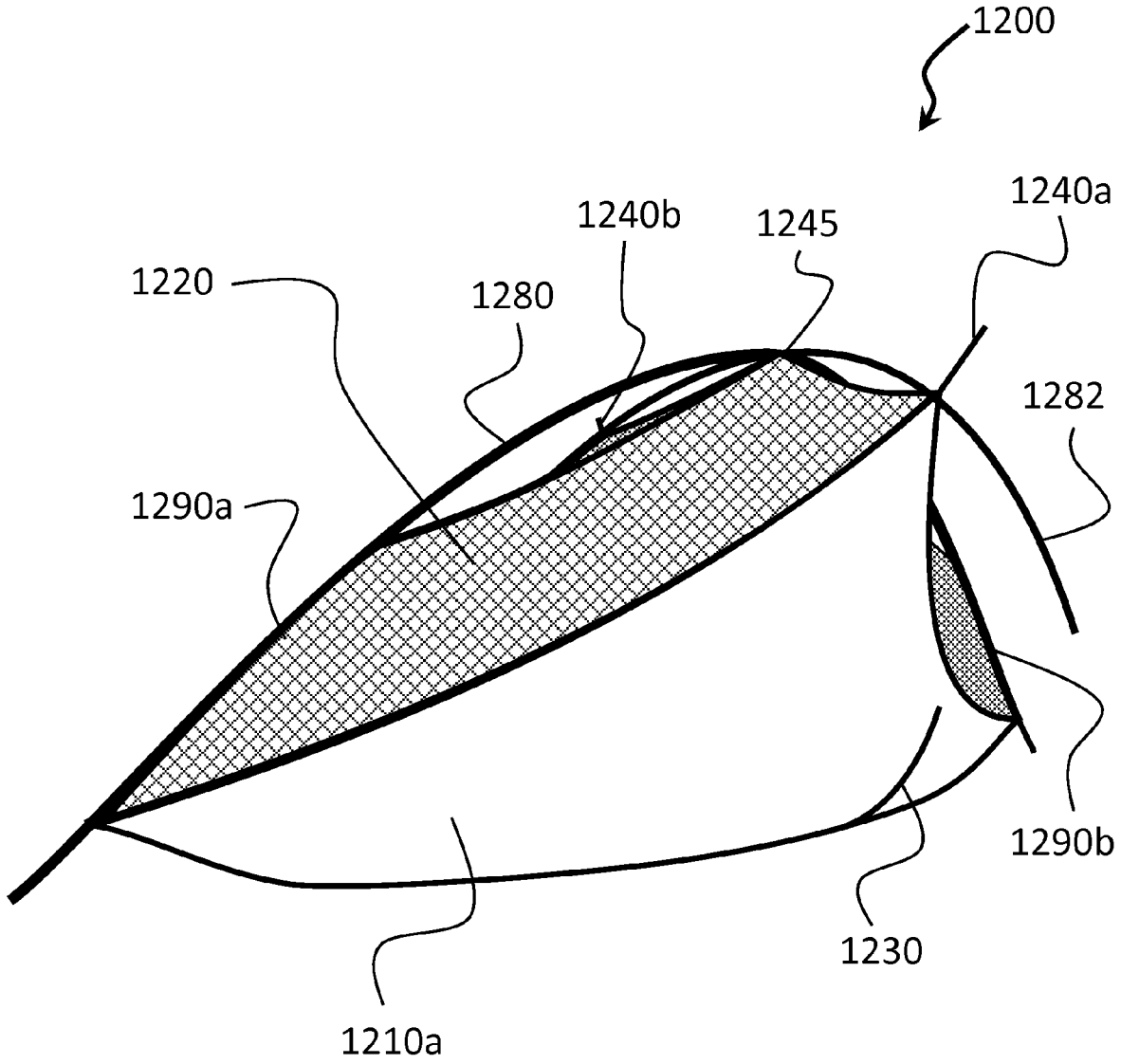
FIG. 14 is a schematic perspective view of another embodiment of a hammock.

In the previously-described embodiments, the use of guy ropes 50*a*, 50*b*, 60*a*, and 60*d* to pull mounting points 250*a* and 250*b*, end guy mounts 350*a* and 350*b*, and side guy mounts 360*a* and 360*b* outwards to create a useable interior volume and a taut fly surface required for shedding of rain and snow has been described. Using guy ropes 50*a*, 50*b*, 60*a* and 60*d* in conjunction with finding or making anchor points A3, A4, A5, and A6 may complicate setting up hammock 10, leading to user frustration and increasing the chance for a poor setup. These potentially negative experiences may be enough for some users to not benefit from the increased comfort and protection offered by hammock 10, and because of such, a further embodiment is provided. In place of guy ropes 50*a*, 50*b*, 60*a*, and 60*d* pulling mounting points 250*a* and 250*b*, end guy mounts 350*a* and 350*b*, and side guy mounts 360*a* and 360*b* outwards, poles 1280 and 1282 may be used to provide the same function. Hammock 1000 shown in FIG. 14 is substantially the same as hammock 10 and is to be used with suspension line 100, but has a modified body 1200 and a modified fly 1300 (not shown).

Body 1200 preferably comprises body panels 1210*a* and 1210*b* similar to body panels 210*a* and 210*b* of body 200, includes door 1230, mesh panels 1220 similar to mesh panel 220, but also includes sleeves 1290*a* and 1290*b*, poles 1280 and 1282, mounting points 1240*a* and 1240*b* similar to 240*a* and 240*b*, clips 1245, and any internal and external elements or accessories described above. Pole 1280 arches from one end of hammock 1000 to the top then down to the opposite end. The ends of pole 1280 preferably extend beyond the ends of body panels 1210*a* and 1210*b* by 0.5 to 36 inches to provide a point for the ends of fly 1300 to attach. At one end pole 1280 is surrounded by sleeve 1290*a* and at the other end by sleeve 1290*b*. Sleeves 1290*a* and 1290*b* provide mesh panels 1220 and the ends of body panels 1210*a* and 1210*b* with an outward force creating an internal volume for the user. Sleeves 1290*a* and 1290*b* are integrally formed in mesh panels 1220. Pole 1282 arches from one side of hammock 1000, across the top and down the opposite side. The ends of pole 1282 extend beyond mounting points 1240*a* and 1240*b* by 0.5 to 60 inches to provide a point for the side of fly 1300 to attach. At mounting points 1240*a* and 1240*b* are a means to securely attach pole 1280 to mounting points 1240*a* and 1240*b*, such as a plastic clip, hook and loop, or other suitable means. Clip 1245 secures poles 1280 and 1282 to one another and supports the roof section of mesh panel 1220 to prevent it from sagging into the interior volume.

Fly 1300 (not shown) is similar to fly 300 and provides rain, sun and wind protection for body 1200 by covering the top and sides. The ends of fly 1300 attach to the ends of pole 1280, and the sides of fly 1300 attach to the ends of pole 1282 to create a taut and waterproof surface.

In this embodiment, poles 1280 and 1282 are made from multiple sections of 20 mm carbon fiber tube with a 2 mm thick wall, although different cross section profiles, thicknesses, diameters, materials, and thickness and diameter variations may be used. Other pole section materials may include aluminum, fiberglass, steel, titanium, or inflatable tubes. The ends of poles 1280 and 1282 that extend beyond mesh panels 1220 and body panels 1210*a* and 1210*b* may also be detachable to reduce weight when fly 1300 is not being used, and thus limit the risks associated with having pointy objects protruding outwards. While two poles are described in FIG. 14, it is also possible to use more poles or a combination of poles and guy ropes to provide the necessary outward forces required for the body and fly, such as using only pole 1280 to support the ends of the body and fly, and using guy ropes 60*a* and 60*b* to support the side of the fly.

While sleeves 1290*a* and 1290*b* along with clip 1245 and pole securing means at mounting points 1240*a* and 1240*b*, it should be understood by one of ordinary skill in the art that a variety of means to secure poles 1280 and 1282 to body panels 1210*a* and 1210*b*, and mesh panels 1220 may be used, along with different mounting positions and locations. One such alternative includes the use of a first sleeve extending the entire length of mesh panel 1220 to secure pole 1280 and a second sleeve extending the width of mesh panel 1220 to secure pole 1282. Alternatively again, sleeves 1290*a* and 1290*b* may be replaced entirely by one or more plastic clips.

In the above described embodiment poles 1280 and 1282 are positioned on the upper surfaces of body 1200, alternative placements that achieve the same or similar outcome may be used, such as to the side or on the underside of body 1200.

While many of the above described sections of fabric are described as being connected, it would be obvious to one skilled in the art that various methods may be used independently, or in conjunction, such as sewing, thermal bonding, or any well know fabric welding techniques.

Although embodiments of the hammock have been shown and described above, those of skill in the art will appreciate that further variations and modifications may be made without departing from the spirit and scope thereof as defined by the appended claims.

What is claimed is:

1. A hammock comprising:

a substantially square section of fabric having a fabric bias direction which is disposed at substantially forty five degrees with respect to fabric warp and weft directions;

said section of fabric comprising first, second, third, and fourth corners, wherein said first and second corners are diagonally opposed to each other, and wherein said third and fourth corners are diagonally opposed to each other;

said first and second corners being disposed along the fabric bias direction;

said third and fourth corners having a wedged shaped section of material removed to reduce the length of the edges of said section of fabric;

wherein, when suspending said section of fabric from said first, second, third and fourth corners, said first and second corners are connected to respective points above said section of fabric, and said third and fourth corners are connected to respective points below said section of fabric, thereby forming a substantially horizontal and sleep surface between said third and fourth corners.

2. The hammock of claim 1 wherein said substantially square section of material is formed by at least one piece of material.

3. The hammock of claim 2 wherein said at least one piece of material comprises a woven fabric.

4. The hammock of claim 2 wherein said substantially square section comprises a convex quadrilateral.

5. The hammock of claim 1 wherein the third and fourth corners of said substantially square section of material are pulled outward using guy ropes.

6. The hammock of claim 5 wherein said hammock includes an integrated or non-integrated suspension line.

7. The hammock of claim 6 wherein said suspension line comprises at least one tensioning device.

8. The hammock of claim 5 wherein said hammock comprises a mesh panel such that the exterior surface of said hammock is substantially tetrahedral in shape.

9. The hammock of claim 5 wherein said hammock comprises an overhead grab handle.

10. The hammock of claim 5 wherein said hammock comprises interior pockets, exterior pockets, or both interior and exterior pockets.

11. The hammock of claim 5 wherein said hammock comprises at least one interior or exterior loop for attaching at least one accessory.

12. The hammock of claim 5 wherein said hammock includes a fly.

13. The hammock of claim 12 wherein said fly is constructed from a woven or non-woven material that is at least one of waterproof or water-resistant.

14. The hammock of claim 12 wherein said fly covers at least the top of said hammock.

15. The hammock of claim 12 wherein said fly comprises 4 guy ropes.

16. The hammock of claim 15 wherein said fly comprises first and second transverse openings along opposite sides extending inward from the edge of said fly, and said first and second openings are unfastenably coupled by closure means.

17. The hammock of claim 16 wherein the inward ends of said first and second openings form an opening to accommodate a suspension line.

18. A hammock comprising:

a substantially square sheet of fabric having (i) a fabric bias direction which is disposed at substantially forty five degrees with respect to fabric warp and weft directions, and (ii) first, second, third, and fourth corners, the first and second corners being disposed along the fabric bias direction, each of the third and fourth corners having a wedged shaped section of material removed therefrom;

the first and second corners being configured to suspend the hammock from respective spaced-apart support points above the hammock, the third and fourth corners being configured to suspend the hammock from respective spaced-apart support points below the hammock.

19. A hammock, comprising;

a suspension rope configured to be suspended between two upper anchor points;

a fabric base having a fabric bias direction which is disposed at substantially forty five degrees with respect to fabric warp and weft directions, the fabric comprising first, second, third, and fourth corners, the first and second, the first and second corners being disposed along the fabric bias direction, each of the third and fourth corners having a wedged shaped section of material removed therefrom, the first and second corners configured to be coupled to said suspension rope;

a fly having coupling structure configured to suspend said fly from said suspension rope and above said base; and lower coupling structure coupled to the third and fourth corners and configured to be coupled between two lower anchor points which are below said two upper anchor points, whereby said lower coupling structure is configured to apply tension to said base in a direction substantially orthogonal to a direction of tension applied to said base by said suspension rope.

20. The hammock of claim 19 wherein said suspension rope comprises a first length of rope, a second length of rope, a third length of rope, a first mounting point and a second mounting point, wherein said first and second lengths of rope are connected at said first mounting point and said second and third lengths of rope are connected at said second mounting point.

* * * * *